US010947002B2

(12) United States Patent
Albright et al.

(10) Patent No.: US 10,947,002 B2
(45) Date of Patent: Mar. 16, 2021

(54) REVERSE PRESSURE CAN END

(71) Applicant: Stolle Machinery Company, LLC, Centennial, CO (US)

(72) Inventors: Steven Todd Albright, Covington, OH (US); Dennis Cornelius Stammen, Brookville, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 47 days.

(21) Appl. No.: 16/440,391

(22) Filed: Jun. 13, 2019

(65) Prior Publication Data

US 2019/0291914 A1 Sep. 26, 2019

Related U.S. Application Data

(63) Continuation-in-part of application No. 15/690,590, filed on Aug. 30, 2017, now Pat. No. 10,518,926.

(51) Int. Cl.

| | |
|---|---|
| ***B65D 1/40*** | (2006.01) |
| ***B65D 17/34*** | (2006.01) |
| ***B65D 1/16*** | (2006.01) |

(52) U.S. Cl.

CPC ..... *B65D 1/40* (2013.01); *B65D 1/165* (2013.01); *B65D 17/34* (2018.01)

(58) Field of Classification Search

CPC ..... B65D 1/40; B65D 17/34; B65D 1/165; B65D 17/4011; B65D 71/00; B65D 51/007; B65D 2571/00; B65D 1/00; B65D 2517/5083; B21D 51/44; B21D 51/2653; B21D 21/00; B21D 51/2669; B21D 51/26; B21D 51/16; B21D 51/38; B21D 51/2607

USPC ..... 220/600–638, 906; 215/370–378

See application file for complete search history.

(56) References Cited

U.S. PATENT DOCUMENTS

| | | | | |
|---|---|---|---|---|
| D32,681 | S | 5/1900 | Morgenthaler | |
| 2,234,485 | A | 3/1941 | Connor | |
| 3,115,985 | A | 12/1963 | Fried | |
| D199,548 | S | 11/1964 | Zundel | |
| 3,251,515 | A | 5/1966 | Henchert et al. | |
| D206,500 | S | 12/1966 | Nissen et al. | |
| 3,417,898 | A | 12/1968 | Bozek et al. | |
| D224,962 | S | 10/1972 | Saunders | |
| 4,017,000 | A * | 4/1977 | Woodley | B21D 51/383 220/270 |
| D246,157 | S | 10/1977 | Kocour et al. | |
| 4,093,102 | A | 6/1978 | Kraska | |
| D255,424 | S | 6/1980 | Bathurst | |
| D257,228 | S | 10/1980 | Saunders | |

(Continued)

FOREIGN PATENT DOCUMENTS

| | | |
|---|---|---|
| EP | 004691558-0001 | 4/2018 |
| EP | 004691558-0002 | 4/2018 |

OTHER PUBLICATIONS

Stolle Machinery Company, LLC, PCT Application No. PCT/US20/035521, International Search Report, dated Aug. 19, 2020, 15 pages.

*Primary Examiner* — Kareen K Thomas

(74) *Attorney, Agent, or Firm* — Eckert Seamans Cherin & Mellott, LLC

(57) ABSTRACT

A can end includes a center panel, an annular portion disposed about the center panel, a chuck wall disposed about the annular portion, a curl extending radially outwardly from the chuck wall, the annular portion including a subsurface step.

18 Claims, 20 Drawing Sheets

(56) References Cited

U.S. PATENT DOCUMENTS

D263,802 S 4/1982 Fraze
D275,373 S 9/1984 Brown et al.
D282,616 S 2/1986 Gallagher et al.
D285,661 S 9/1986 Brownbill
4,749,100 A 6/1988 Eberhart
D300,608 S 4/1989 Taylor et al.
D304,302 S 10/1989 Dalli et al.
4,893,725 A 1/1990 Ball et al.
D310,025 S 8/1990 Foley
D312,404 S 11/1990 Bray et al.
5,149,238 A 9/1992 McEldowney et al.
5,356,256 A 10/1994 Turner et al.
D352,898 S 11/1994 Vacher
D385,192 S 10/1997 Hurst et al.
D396,635 S 8/1998 McEldowney
D402,555 S 12/1998 McEldowney et al.
5,857,374 A 1/1999 Stodd
D415,425 S 10/1999 Turner et al.
5,971,259 A * 10/1999 Bacon ..... B65D 15/06 220/619
6,065,634 A 5/2000 Brifcani et al.
D452,155 S 12/2001 Stodd
6,386,013 B1 5/2002 Werth
6,419,110 B1 * 7/2002 Stodd ..... B65D 7/44 220/623
6,460,723 B2 * 10/2002 Nguyen ..... B21D 51/38 220/619
6,499,622 B1 * 12/2002 Neiner ..... B21D 51/32 220/619
D471,453 S 3/2003 Stodd
6,561,004 B1 * 5/2003 Neiner ..... B21D 51/32 413/2
6,702,538 B1 3/2004 Heinicke et al.
6,736,283 B1 5/2004 Santamaria et al.
6,761,280 B2 * 7/2004 Zonker ..... B65D 17/08 220/269
6,772,900 B2 * 8/2004 Turner ..... B65D 17/08 220/269
D495,600 S 9/2004 Kouri
7,100,789 B2 * 9/2006 Nguyen ..... B21D 51/32 220/619
D562,684 S 2/2008 Brashear
7,341,163 B2 * 3/2008 Stodd ..... B21D 51/32 220/623
7,478,550 B2 1/2009 Wynn et al.
7,591,392 B2 9/2009 Watson et al.
7,644,833 B2 * 1/2010 Turner ..... B65D 17/502 220/269
7,819,275 B2 10/2010 Stodd et al.
7,927,667 B2 4/2011 McEldowney
7,938,290 B2 5/2011 Bulso
D641,239 S 7/2011 Ramsey et al.
D641,622 S 7/2011 Fields
D643,718 S 8/2011 Fields
8,011,527 B2 9/2011 Forrest et al.
D653,109 S 1/2012 Stammen
D669,781 S 10/2012 Fields
8,490,825 B2 * 7/2013 Reed ..... B65D 17/08 220/623
8,684,211 B1 4/2014 Stammen
8,875,936 B2 * 11/2014 Turner ..... B65D 17/4012 220/619
8,973,780 B2 * 3/2015 Forrest ..... B65D 7/40 220/623
9,016,504 B2 4/2015 McClung et al.
D744,861 S 12/2015 Fortner
9,260,217 B2 * 2/2016 Niec ..... B65D 17/4011
D767,329 S 9/2016 Mock
D770,895 S 11/2016 Brown
D774,887 S 12/2016 Torrison et al.
9,573,183 B2 2/2017 McClung et al.
9,616,483 B2 4/2017 Stammen
D816,500 S 5/2018 Torrison et al.
10,246,217 B2 4/2019 Stodd et al.
D850,291 S 6/2019 Bidzinashvili
2005/0006395 A1 * 1/2005 Reed ..... B21D 51/38 220/619
2005/0029269 A1 * 2/2005 Stodd ..... B21D 51/32 220/619
2005/0252922 A1 11/2005 Reed et al.
2006/0096994 A1 * 5/2006 Turner ..... B65D 17/08 220/619
2009/0039091 A1 2/2009 Forrest et al.
2010/0059530 A1 * 3/2010 Niec ..... B65D 17/4011 220/623
2012/0175376 A1 7/2012 Watson et al.
2012/0292329 A1 11/2012 Bulso
2013/0098925 A1 4/2013 Dunwoody
2013/0309043 A1 11/2013 McClung et al.
2018/0127145 A1 5/2018 Studd et al.
2019/0061987 A1 2/2019 Will et al.
2019/0061995 A1 2/2019 Albright et al.
2019/0291914 A1 9/2019 Albright et al.

* cited by examiner

REVERSE PRESSURE CAN END

CROSS REFERENCE TO RELATED APPLICATION

This application is a continuation-in-part application of and claims priority to U.S. patent application Ser. No. 15/690,590, filed Aug. 30, 2017, entitled REVERSE PRESSURE CAN END.

BACKGROUND OF THE INVENTION

Field of the Invention

The disclosed and claimed concept relates to can ends and, more particularly, to can ends made from a sheet material having a reduced base gage and/or a reduced final thickness relative to known can ends. The disclosed concept also relates to tooling and associated methods for providing such can ends.

Background Information

Metallic containers (e.g., cans) are structured to hold products such as, but not limited to, food and beverages. Generally, a metallic container includes a can body and a can end. The can body, in an exemplary embodiment, includes a base and a depending sidewall. The can body defines a generally enclosed space that is open at one end. The can body is filled with product and the can end is then coupled to the can body at the open end. The container is then placed in an oven and heated to cook the product and/or sterilize the product. The heating and subsequent cooling of the container, and food, causes pressure changes. That is, as the food is heated, the pressure inside the container increases. This pressure is identified as an "internal" or "positive" pressure. Containers are structured to resist deformation due to the internal pressure. In an exemplary embodiment, the heating of the container, and food, is performed by pressurized steam. The pressurized steam applies pressure to the outer side of the container. Pressure on the outer side of the container is "external" or "reverse" pressure. Containers are not always structured to resist deformation due to external pressure. Thus, if the metal of either, or both, the can body and/or the can end is weak, the can body and/or the can end will deform due to pressure changes and the container will be defective.

A "can end," as used herein, is the element coupled to a can body to form a container. The "can end" includes a tab or similar device structured to open the container. As discussed below, a "can end" is, typically, formed from a "shell." That is, a shell is formed from a generally planar blank cut from sheet material. The blank is formed to include an annular countersink, a chuck wall, and other constructs. The concept disclosed and claimed below are discussed as part of a "can end." It is understood, however, that the disclosed and claimed concept can be formed while the blank is still a "shell" as opposed to a "can end." That is, while the following discussion uses the term, "can end," the discussion is also applicable to "shells."

A container is exposed to pressures during processing. For example, some food items are cooked and/or sterilized while in the container. Such a container is exposed to both internal pressure, also identified herein as "buckle" or "buckle pressure," as well as external pressure, also identified herein as "reverse buckle" or "reverse buckle pressure." A container, that is the can body and the can end, must have the strength to resist deformation due to buckle pressure and/or reverse buckle pressure.

Generally, the strength of the container is related to the thickness of the metal from which the can body and the can end is formed, as well as, the shape of these elements. This application primarily addresses the can ends rather than the can bodies. The can ends are either a "sanitary" can end or an "easy open" end. As used herein, a "sanitary" end is a can end that does not have a tab or score profile to open and would have to be opened by use of a can opener or other device. As used herein, an "easy open" can end includes a tear panel and a tab. The tear panel is defined by a score profile, or scoreline, on the exterior surface (identified herein as the "public side") of the can end. The tab is attached (e.g., without limitation, riveted) adjacent the tear panel. The pull tab is structured to be lifted and/or pulled to sever the scoreline and deflect and/or remove the severable panel, thereby creating an opening for dispensing the contents of the container. The following addresses an "easy open" can end but is also applicable to a "sanitary" can end. That is, a "sanitary" can end is produced in a similar manner, and coupled to a can body in a similar manner. Thus, as used herein, a can end is further defined as including constructs that are used for both "sanitary" can ends and "easy open" ends.

When the can end is made, it originates as a blank, which is cut from a sheet metal product (e.g., without limitation, sheet aluminum; sheet steel). In an exemplary embodiment, the blank is then formed into a "shell" in a shell press. As used herein, a "shell" is a construct that started as a generally planar blank and which has been subjected to forming operations other than rivet forming and tab staking. The shell press includes a number of tool stations where each station performs a forming operation (or which may include a null station that does not perform a forming operation). The blank moves through successive stations and is formed into the "shell." A shell is, in an exemplary embodiment, a "sanitary" can end that is structured to be coupled to a can body.

For an "easy open" end, a shell is further conveyed to a conversion press, which also has a number of successive tool stations. As the shell advances from one tool station to the next, conversion operations such as, for example and without limitation, rivet forming, paneling, scoring, embossing, and tab staking, are performed until the shell is fully converted into the desired can end and is discharged from the press. Thus, as used herein, a "can end" includes a "shell" as well as a construct including a tab and a score line.

In the can making industry, large volumes of metal are required in order to manufacture a considerable number of cans. Generally, steel cans are made from sheet material having a base gauge, or an original thickness (as used herein, the terms are equivalent to each other), of between 0.0050 inch to 0.0096 inch. The required original thickness of the material is determined by a variety of factors such as, but not limited to, the dimensions of the finished can, the temperature to which the can (and contents) are exposed during processing, the nature of the contents to be placed in the cans, as well as other factors. The original thickness of the material for each specific type, model, and/or style of can and/or can end is, as used herein, the "established thickness."

That is, for example, the steel used for a common 18.6 oz. soup can has an established thickness of 0.0090 inch. The can end/container formed from steel with this established thickness is structured to withstand a buckle pressure of 34.8 psi and a reverse buckle pressure of 33.0 psi.

An ongoing objective in the industry is to reduce the amount of metal that is consumed. Efforts are constantly being made, therefore, to reduce the thickness or gauge (sometimes referred to as "down-gauging") of the stock material from which can ends, tabs, and can bodies are made. Alternatively, the material can be thinned from the base gauge to have a thinner, or partially thinner, final thickness that is less than the base gauge. However, as less material (e.g., thinner gauge) is used, problems arise that require the development of unique solutions. As noted above, a common problem associated with can ends for food cans is that they are subject to pressure changes associated with processing the food product within the can. When the base gauge of the metal is too thin, the can end deforms. This is a problem.

One solution to the problems associated with using thin metal is to provide strengthening constructs in the can end. Strengthening constructs include, but are not limited to, recessed or protruding panels that add rigidity to the generally planar can ends. The strengthening constructs are, in an exemplary embodiment, created by forming the panels in the body of the can end. The can end includes other, similar constructs such as recesses for the tab. As noted above, however, the can end and the strengthening constructs are, in an exemplary embodiment, structured to resist internal pressure.

There is, therefore, a need for a can end having a shape that resists deformation even when the can end is made from a down-gauged, i.e., thinner, metal. There is a further need for a can end having a shape that resists deformation from external or reverse pressure.

SUMMARY OF THE INVENTION

The disclosed and claimed concept provides a can end structured to be coupled to a container, the can end including a down-gauging construct. That is, the can end includes a center panel, an annular portion disposed about the center panel, a chuck wall disposed about the annular portion, a curl extending radially outwardly from the chuck wall, the annular portion including an annular ridge and an annular countersink, the annular countersink disposed adjacent and about the annular ridge. The annular countersink and the annular ridge are structured to resist deformation from external or reverse pressure. A can end in the disclosed configuration solves the problems stated above and allows the can ends to be made from a material with a decreased original thickness.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
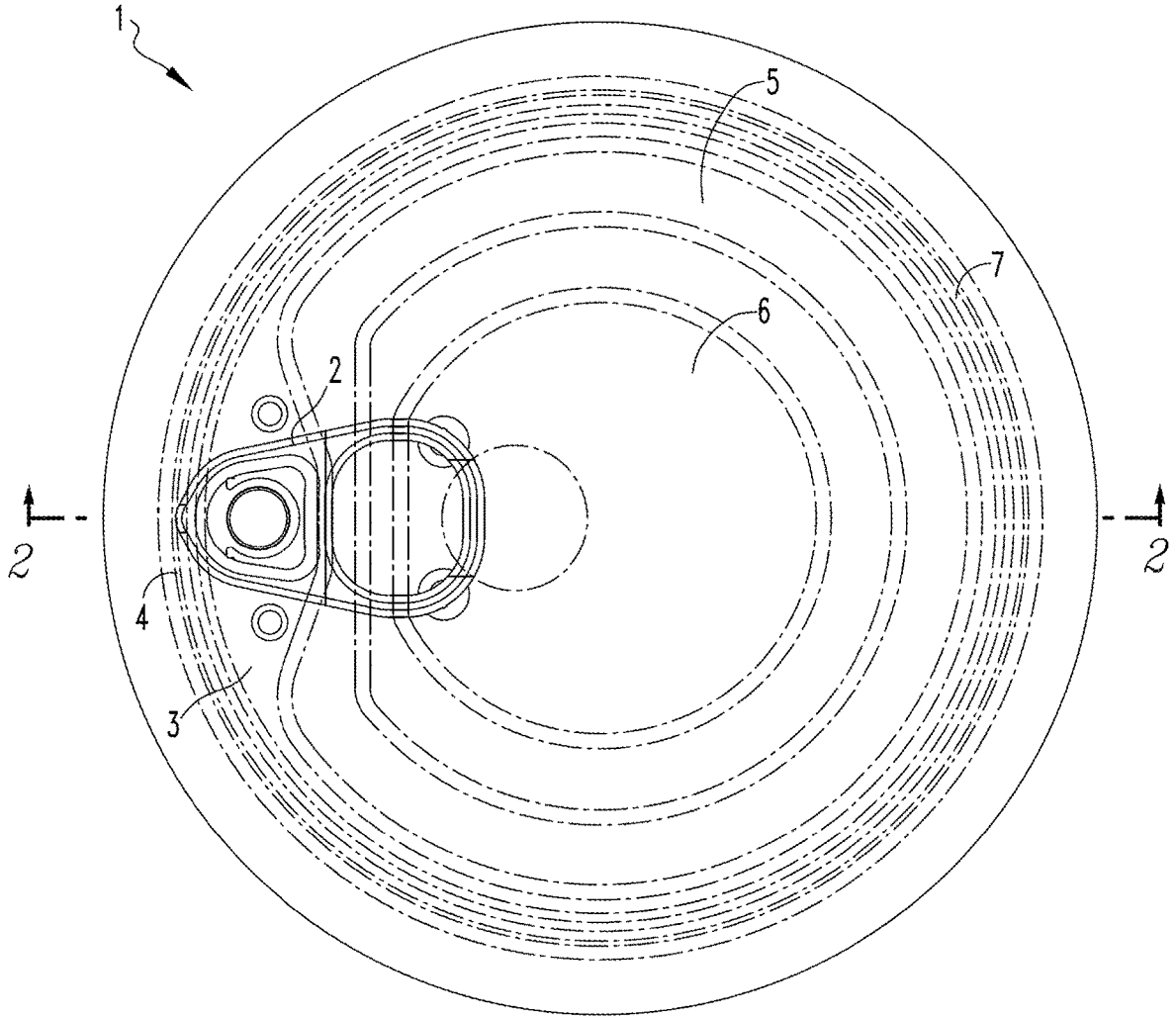
FIG.1 (PRIOR ART)
FIG. 1 is a top view of a prior art can end.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve as a whole, moves relative to the body of the automobile.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate.

As used herein, "depending" means to extend at an angle other than zero (0°) from another element without regard to direction. That is, for example, a "depending" sidewall may extend generally upwardly from a base. Further, a "depending" sidewall inherently has a distal end.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As used herein, "generally curvilinear" includes elements having multiple curved portions, combinations of curved portions and planar portions, and a plurality of planar portions or segments disposed at angles relative to each other thereby forming a curve.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

Figure 2:
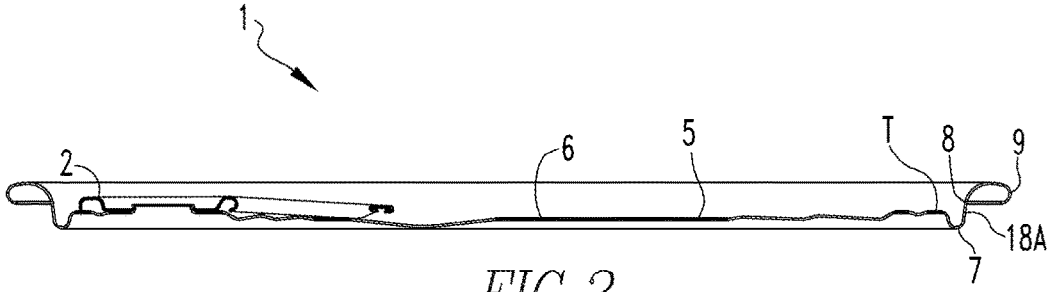
FIG.2 (PRIOR ART)
FIG. 2 is a side elevation sectional view of a prior art can end.

The following discussion and the Figures use a generally cylindrical can end 12, discussed below, as an example. It is understood that the disclosed and claimed concept is operable with can ends 12 of any shape and the cylindrical shape discussed and shown is exemplary only. FIGS. 1 and 2 show a prior art easy open can end 1, hereinafter "prior can end" 1. The prior can end 1 includes an opener (e.g., without limitation, pull tab 2), which is attached (e.g., without limitation, riveted) to a tear strip or severable panel 3. The severable panel 3 is defined by a scoreline 4 in the exterior surface 5 (e.g., public side) of the prior can end 1. The pull tab 2 is structured to be lifted and/or pulled to sever the scoreline 4 and deflect and/or remove the severable panel 3, thereby creating an opening for dispensing the contents of the can (not shown). As shown, the prior can end 1, when viewed in cross-section as in FIG. 2, includes a center panel 6, an annular countersink 7, a chuck wall 8, and a curl 9. It is understood that the prior can end 1 is formed from a generally, or substantially, planar blank 10 (FIG. 9A, shown schematically). In an exemplary embodiment, the blank 10 is a generally planar disk, as is known.

Figure 3:
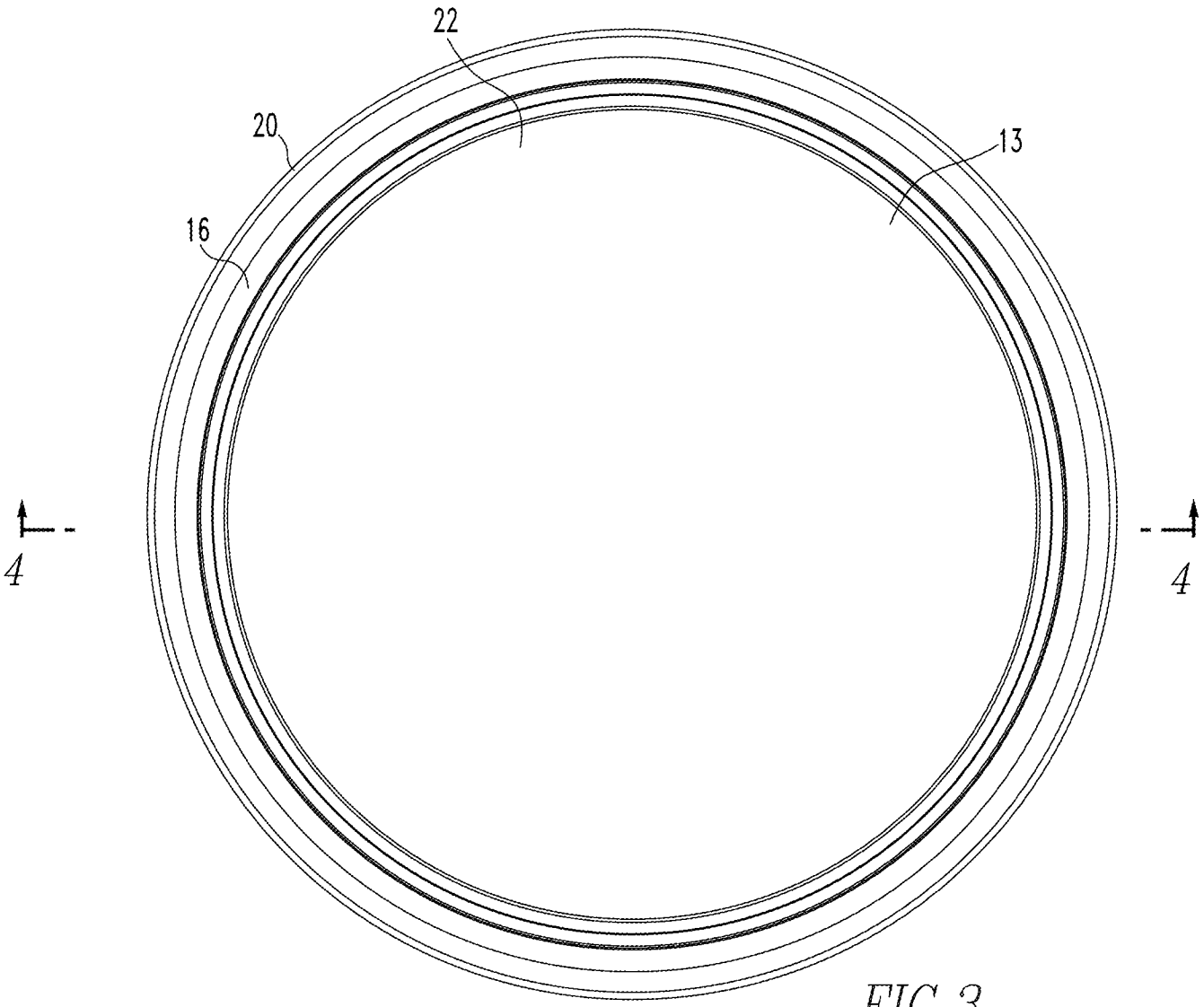
FIG. 3 is a top view of a shell.
Figure 4:
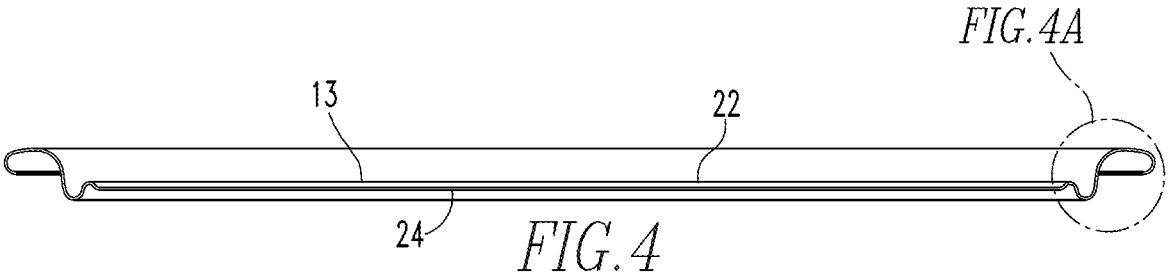
FIG. 4 is a cross-sectional view of a shell.
Figure 4A:
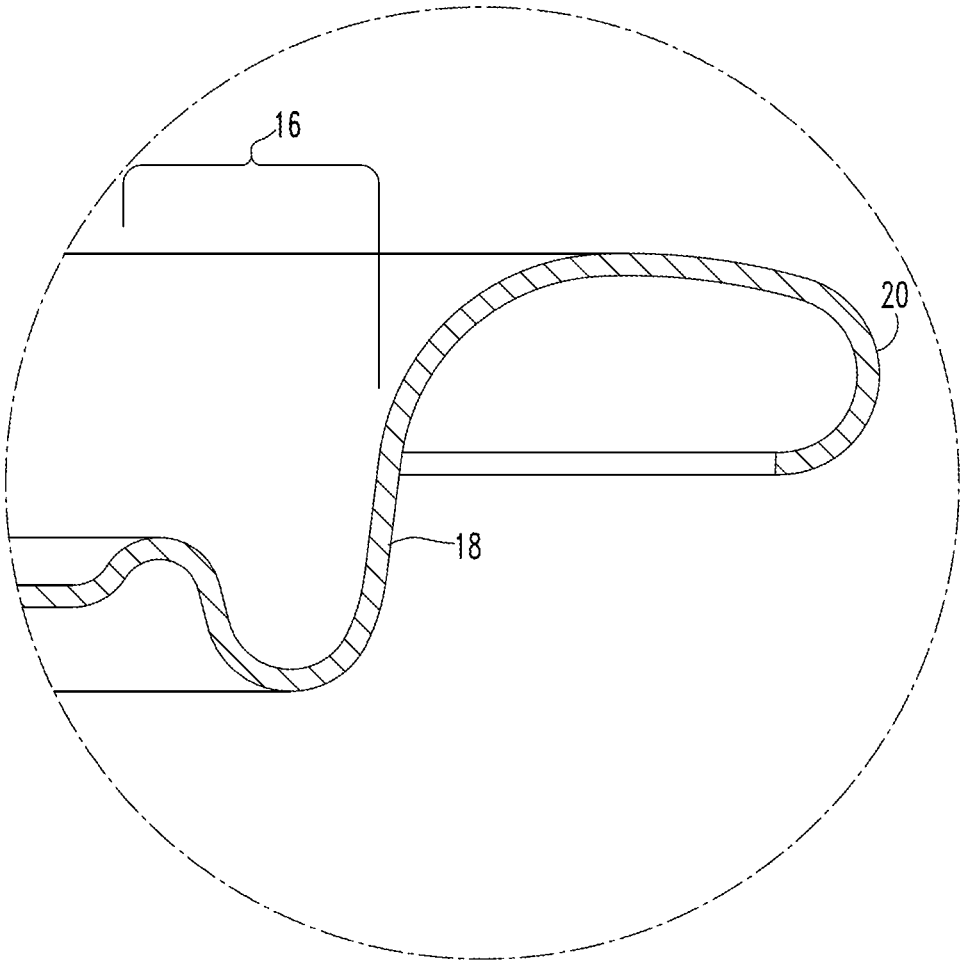
FIG. 4A is a detail view of a shell.
Figure 5:
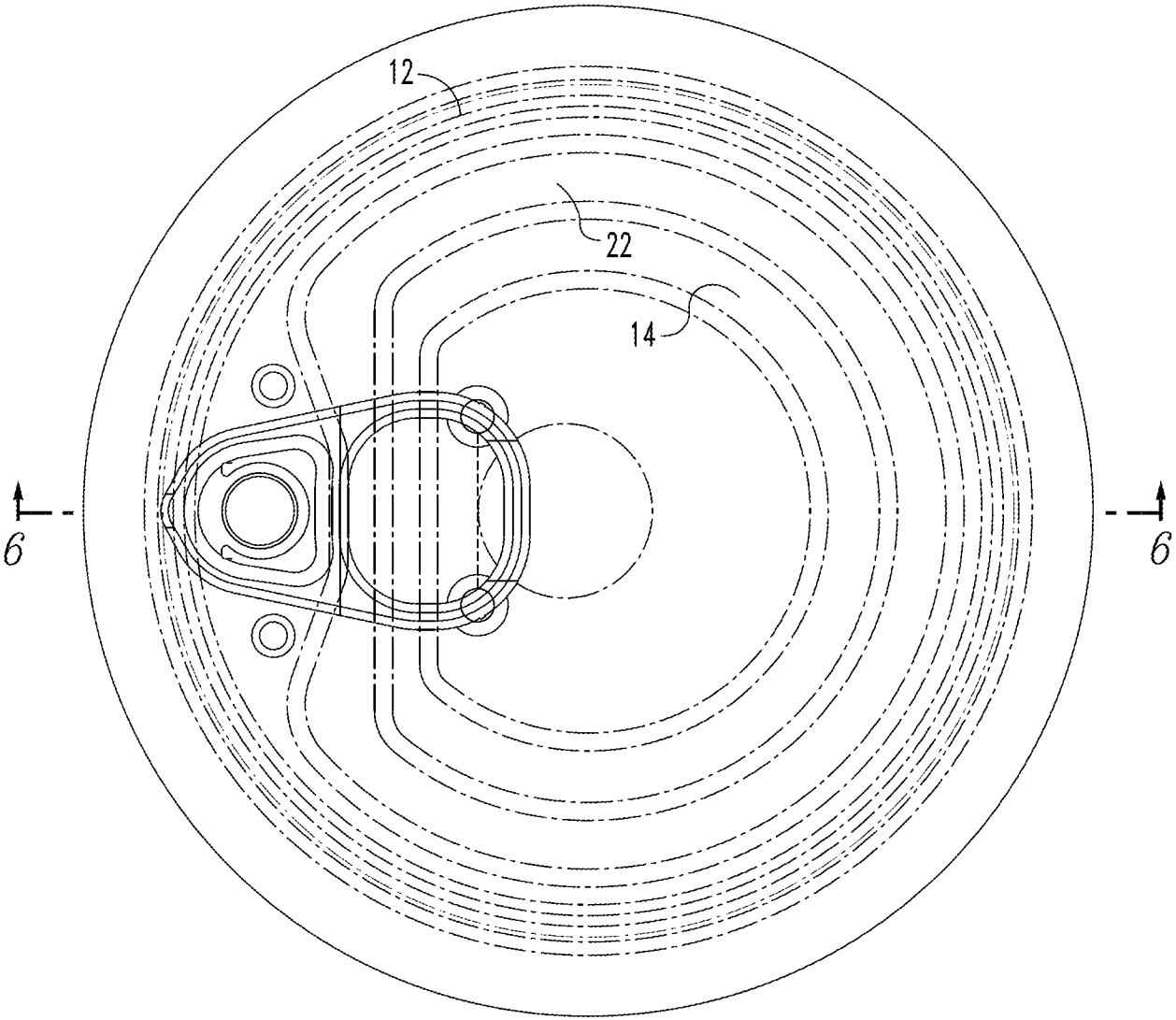
FIG. 5 is a top view of a can end.
Figure 6:
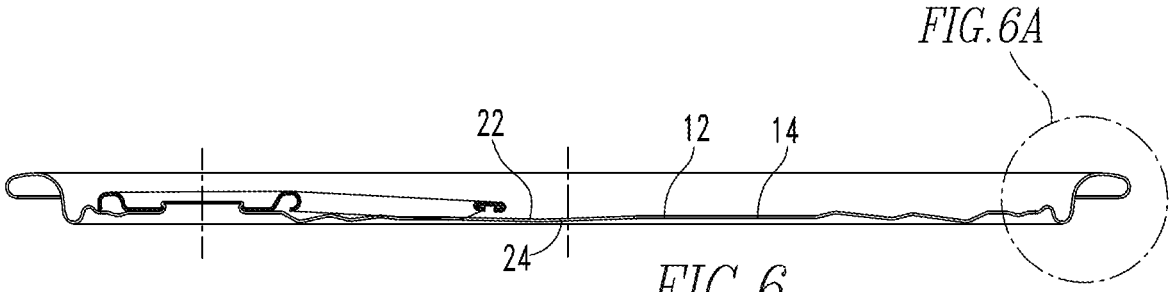
FIG. 6 is a cross-sectional view of a can end.
Figure 8:
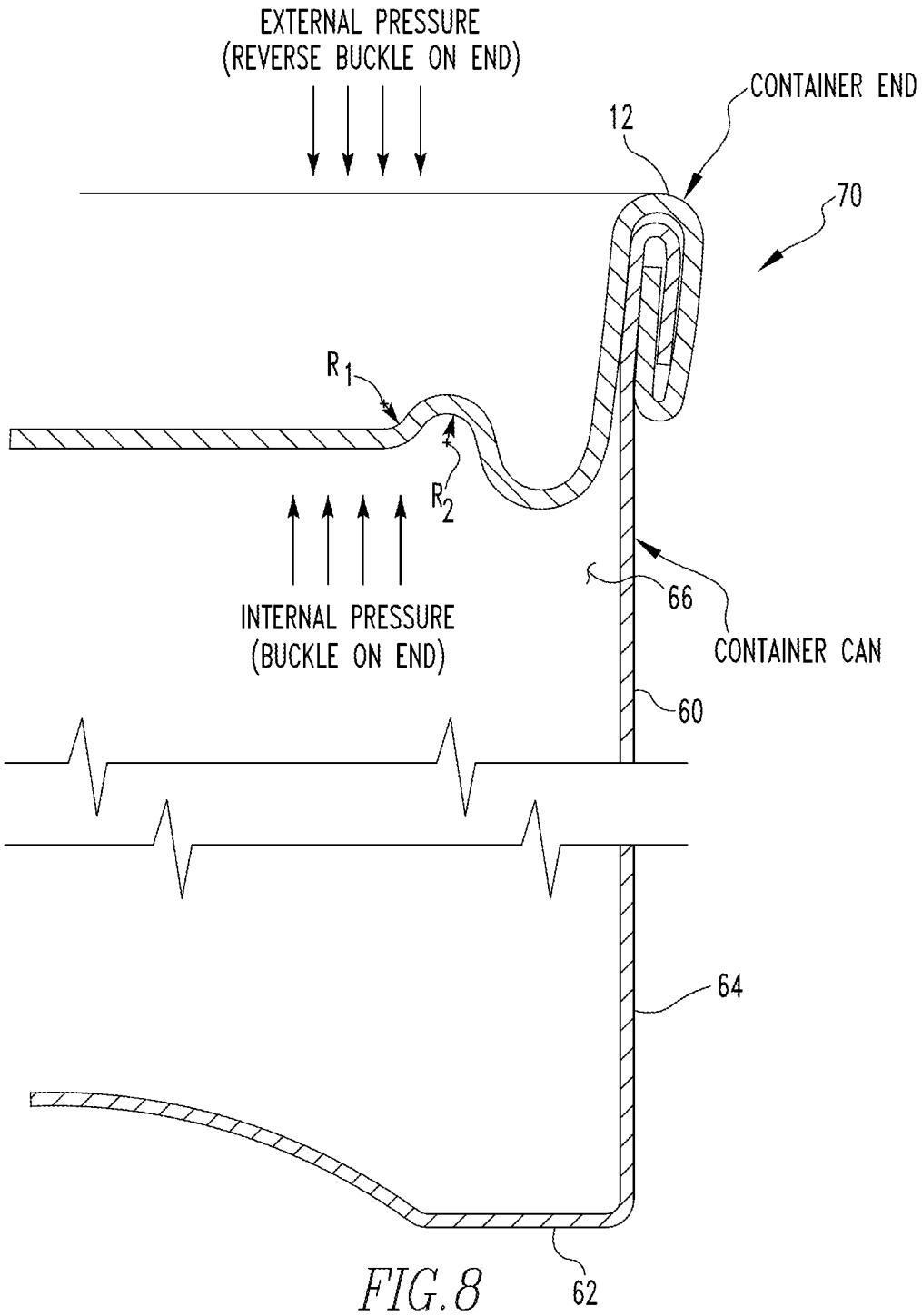
FIG. 8 is a cross-sectional view of a can end coupled (seamed) to a can body.

A blank 10 is initially formed into an improved shell 13, FIGS. 3-4, which is then further formed into an improved can end 12 (hereinafter, and as used herein, "can end" 12) shown in FIGS. 5 and 6. As noted above, and as used herein, a "can end" 12 and a shell 13 include common elements and similar reference numbers are used in the Figures to identify these elements including: a center panel 14, an annular portion 16, a chuck wall 18 and a curl 20. Further, the can end 12 has an exterior, or "public," side 22 and an interior, or "product," side 24. The public and product sides 22, 24 relate to the configuration of the can end 12 when the can end 12 is coupled to a filled can body 60 (FIG. 8). As used herein, the center panel 6, 14 is "generally planar" even if it includes recesses, a rivet, and other formed constructs.

Figure 6A:
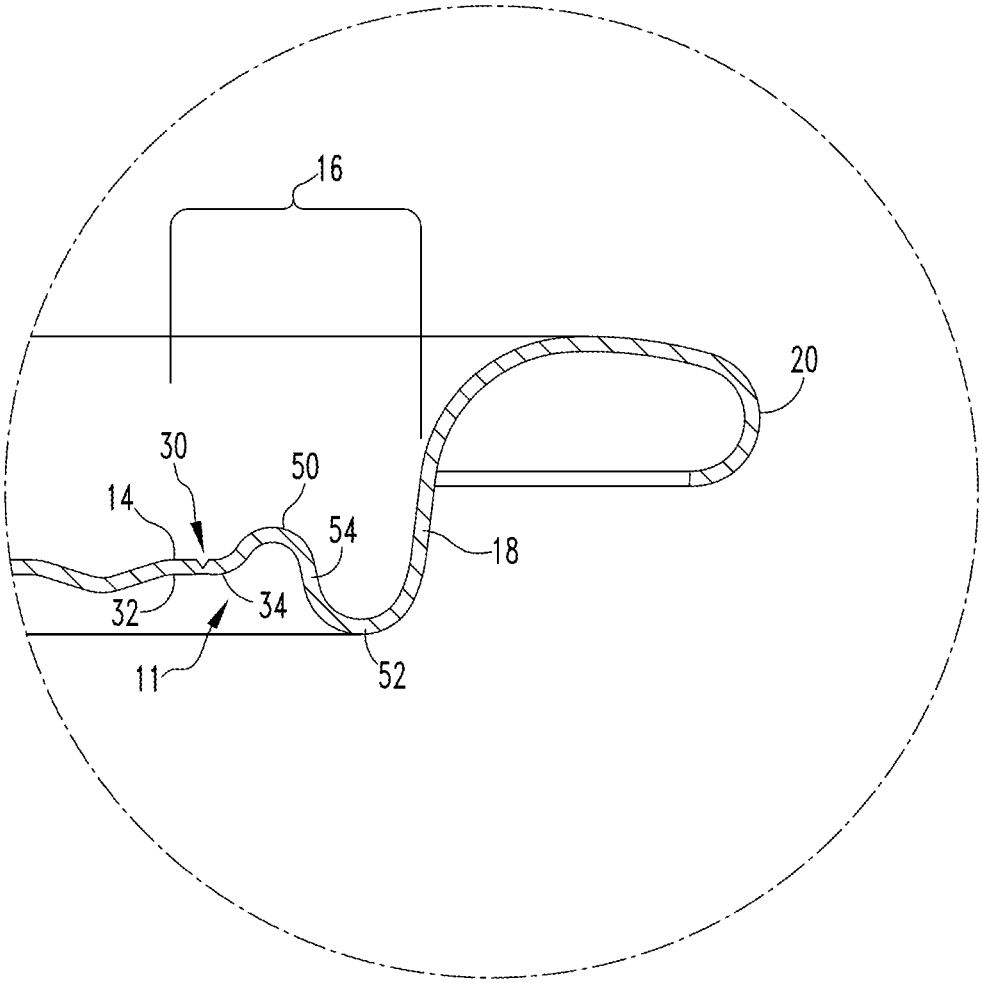
FIG. 6A is a detail view of a can end.

In an exemplary embodiment, the annular portion 16 includes a "down-gauging construct" 11, FIG. 6A. As used herein, a "down-gauging construct" means a construct structured to increase the can end 12 resistance to buckling and other deformations that arise after the can end 12 is coupled to a can body 60. Further, as used herein, a "down-gauging construct" means a construct that is disposed only in the annular portion 16 between the center panel 14 and the chuck wall 18. The down-gauging construct 11 is structured to, and does, allow the can end 12 to be made from a material with a "decreased original thickness."

As noted above, the "established thickness" for a specific can end is determined by many factors such as, but not limited to, the geometry and configuration of the finished container. As such, this application is not limiting a "decreased original thickness" to a specific thickness or range of thicknesses. Instead, as used herein, a "decreased original thickness" means a thickness that is less than the "established thickness." Thus, the "decreased original thickness" varies depending upon the geometry and configuration, as well as other factors, of the finished container. Stated alternately, as used herein, a "decreased original thickness" means that the material has an original thickness that is thinner than the "established thickness" for a specific type, model, and/or style of can end. The "established thickness" for a specific can end is well known in the art.

The following discussion relates to an exemplary can end 12 which is a steel shell/can end 12 used for a common 18.6 oz. soup can which is the same container discussed above in the Background Information. When the can end 12 includes a down-gauging construct 11, the sheet material, i.e., the sheet steel, has an original thickness of about 0.0079 inch. Thus, compared to the established thickness of 0.0090 inch for this exemplary can end, the can end 12 has a "decreased original thickness." Further, use of the down-gauging construct 11 allows the can end to withstand a buckle pressure of 34.6 psi and a reverse buckle pressure of 30.0 psi, see, FIGS. 6A and/or 12A. The pressure resistance of the can end 12 with the down-gauging construct 11 is generally the same as the known can end and the can end 12 with the down-gauging construct 11 can be used in place of the known can end.

That is, a can end 12 made from a material with a decreased original thickness and that includes the concept disclosed herein is usable with the same can body as a can end with the established thickness. This solves the problems stated above. Further, a can end 12 that includes the concept disclosed herein and which is made from material having a "decreased original thickness" is, as used herein, a "decreased original thickness can end" 12.

To provide a reference, the plane of the blank 10 defines, as used herein, the "original plane" of the blank 10 and the resulting can end 12. As discussed below, the "original plane" is also the plane of the center panel 6, 14 immediately adjacent and inside, i.e., toward the center of the can end 12, the annular portion 16. It is noted that, prior can end 1 (FIG. 2) includes an annular countersink 7 that extends toward the product side 24 from the periphery of the center panel 6. That is, the prior can end 1 does not include an annular ridge 50, as defined below.

Figure 7:
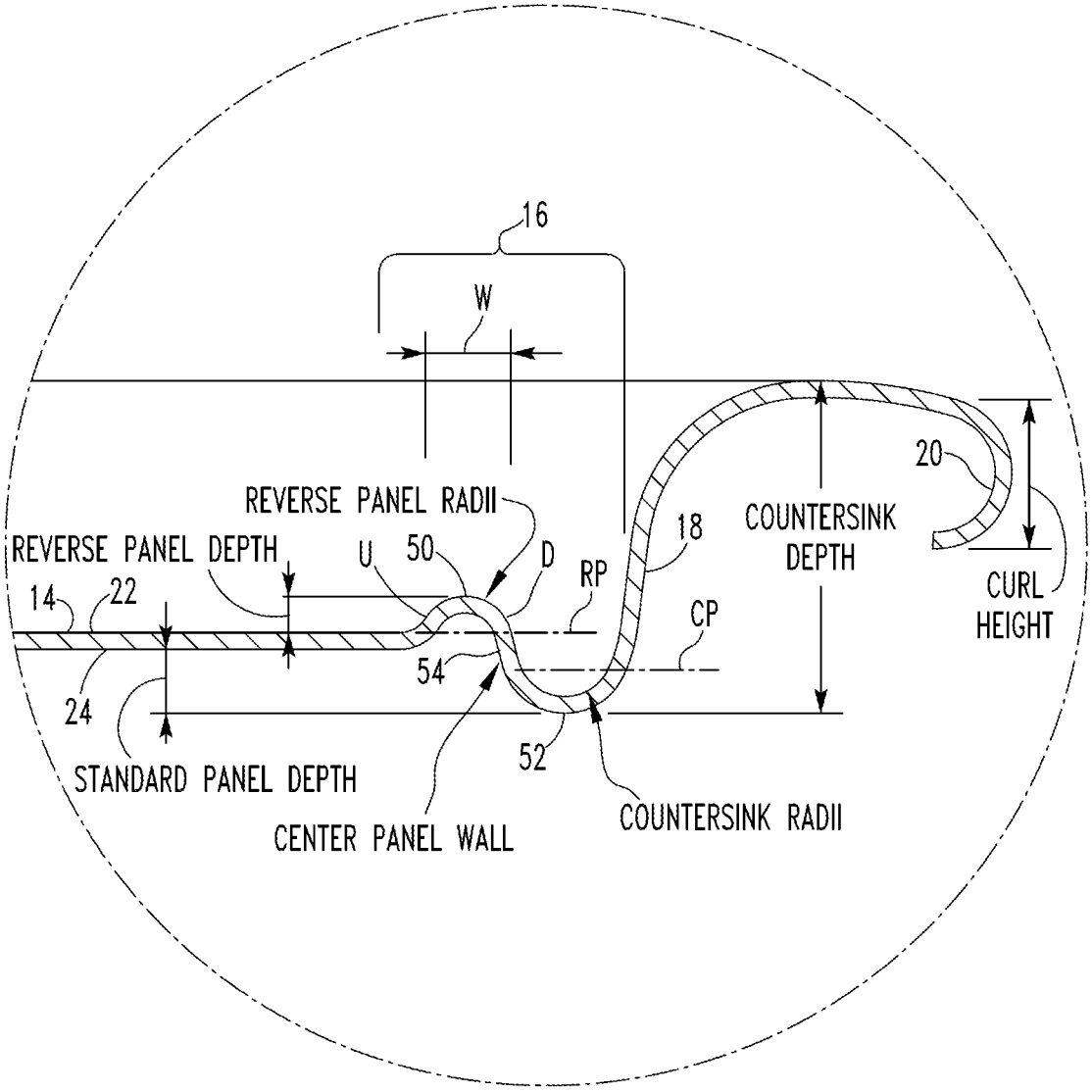
FIG. 7 is a cross-sectional view of a can end identifying selected terms used herein.

As shown in FIG. 7, and as noted above, a can end 12 includes a center panel 14, an annular portion 16, a chuck wall 18 and a curl 20. The following terms are used to describe characteristics of a can end's 12 components. As used herein, the curl 20 has a "curl height" which means the vertical distance between the top of the curl 20 and the distal end of the curl 20. As used herein, the "countersink depth" means the vertical distance between the top of the curl 20 and the bottom of an annular countersink 52, discussed below. As used herein, the "panel depth" means the vertical distance between the bottom of the annular countersink 52 and the bottom of the center panel 14. As used herein, the "reverse panel depth" means the vertical distance between the top of an annular ridge 50, discussed below, and the top of the center panel 14. It is noted that the prior can ends did not have a "reverse panel depth," FIG. 7, because the prior can ends 1 did not have an annular ridge 50. Further, the can end 12 has, as used herein, an "exterior," or "public," side 22 and an "interior," or "product," side 24. The "exterior," or "public," side 22 is the side that, when the can end 12 is coupled to a can body 60, is exposed to the atmosphere. The "interior," or "product," side 24 is the side that, when the can end 12 is coupled to a can body 60, is not exposed to the atmosphere.

The center panel 14 is generally planar. As shown in FIG. 6A, the center panel 14 includes a scoreline 30 on the public side 22. The scoreline 30 defines a tear strip or severable panel 32. In the embodiment shown, the severable panel 32 occupies the majority of the center panel 14 as is common with, but not limited to, a can end 12 for a food container. In this configuration, the center panel 14 includes a peripheral portion 34 and the severable panel 32. It is understood that to open a container including the can end 12, the severable panel 32 is removed (or displaced) relative to the peripheral portion 34.

The annular portion 16 is disposed about the center panel 14 and is unitary therewith. In one exemplary embodiment, the down-gauging construct 11 includes an annular ridge 50. That is, the annular portion 16 includes an annular ridge 50 and an annular countersink 52. As used herein, a "ridge" begins and ends in the same general plane (hereinafter the ridge plane, shown as "RP" in FIG. 7) and includes a peak, i.e., a vertex when viewed as a cross-section with the cross-sectional plane generally perpendicular to the plane of the center panel 14. At the ridge plane, a "ridge" has a maximum width of about 0.100 inch. The width of a ridge is the distance between an upward slope (shown as "U" in FIG. 7) and a downward slope (shown as "D" in FIG. 7) measured at the ridge plane and shown as "W" in FIG. 7. Further, as used herein, an "annular ridge" extends about, or substantially extends about, a severable panel 32. Thus, features on a shell or can end such as wide tiers (such as, but not limited to, tier "T" in FIGS. 1 and 2), localized protrusions or recesses do not define an "annular ridge" as used herein. For example, the "panel formation" (reference number 118) in U.S. Pat. No. 9,616,483 is not, and does not include, an "annular ridge" because the "panel formation 118" does not extend about the severable panel defined by a scoreline.

In an exemplary embodiment, the annular ridge 50 has a height, as measured at the top of the ridge plane to the top of the center panel 14 of between about 0.010 inch and 0.050 inch, or about 0.040 inch. This offset also defines the "reverse panel depth" of the center panel 14. That is, as shown, the ridge plane is substantially the same as the plane of the center panel 14. Thus, as shown in FIGS. 7 and 8, the annular ridge 50 extends upwardly from the center panel 14. In an exemplary embodiment, annular ridge 50 curves upwardly from the center panel 14 (when viewed in cross-section, as shown in FIG. 8) wherein the curve has a radius ($R_1$) of between about 0.010 inch and 0.030 inch, or about 0.015 inch. Further, in an exemplary embodiment, the annular ridge 50 is generally curvilinear or generally arcuate. When the annular ridge 50 is generally arcuate, the annular ridge 50 has an internal radius ($R_2$), i.e., the radius of the curve between and including the upward slope and the downward slope, of between about 0.010 inch and 0.030 inch, or about 0.015 inch. The annular ridge 50 is the portion disposed about, and immediately adjacent, the center panel 14. An annular ridge 50 in any of the configurations and with the characteristics described above solves the problems stated above.

In an exemplary embodiment, the annular portion 16 includes a generally planar portion 54 (when viewed in cross-section as shown in FIG. 7), hereinafter "annular planar portion" 54. It is noted that the plane of the annular planar portion 54 is not in the same plane as, or parallel to, the plane of the center panel 14. That is, the plane of the annular planar portion 54 is angled relative to the plane of the center panel 14. In an exemplary embodiment, the annular planar portion 54 has a length between about 0.015 inch and 0.050 inch, or about 0.035 inch, wherein the "length" is measured from the annular ridge 50 to the annular countersink 52. If included, the annular planar portion 54 is disposed about, and immediately adjacent, the annular ridge 50.

In one embodiment, the annular countersink 52 is disposed about, and immediately adjacent, the annular ridge 50. In another embodiment, the annular countersink 52 is disposed about, and immediately adjacent, the annular planar portion 54. As used herein, the "annular countersink" 52 begins and ends in the same general plane (hereinafter the countersink plane, shown as "CP" in FIG. 7) and includes a nadir, i.e., a bottom vertex when viewed as a cross-section with the cross-sectional plane generally perpendicular to the plane of the center panel 14, as shown in FIG. 7. At the countersink plane, the "annular countersink" 52 has a maximum width of about 0.120 inch. The width of the annular countersink 52 is the distance between the downward slope (not identified in the Figures) and the upward slope (not identified in the Figures) measured at the countersink plane. Further, in an exemplary embodiment, the annular countersink 52 is generally curvilinear or generally arcuate. When the annular countersink 52 is generally arcuate, the annular countersink 52 has an internal radius, i.e., the radius of the curve between and including the upward slope and the downward slope, of between about 0.015 inch and 0.050 inch, or about 0.020 inch.

As shown in FIG. 6A, the chuck wall 18 is disposed about, and immediately adjacent, the annular countersink 52. The curl 20 is disposed about, and immediately adjacent, the chuck wall 18. That is, the curl 20 extends radially outwardly from the chuck wall 18. As is known, and as shown in FIG. 8, the can end 12 is coupled, directly coupled, fixed, or "seamed" (as discussed below) to a can body 60 thereby forming a container 70. A can body 60 includes a base 62 and an upwardly depending sidewall 64. The can body 60 defines a generally enclosed space 66.

As noted above, a can end 12 including an annular portion 16 with an annular ridge 50 and an annular countersink 52 allows for the use of thinner materials, or materials that have been thinned, relative to a prior can end 1. In an exemplary embodiment, the blank 10 or the material from which the blank 10 is formed, has an original thickness. During the forming process of a can end 12, as discussed below, the original thickness is, in one exemplary embodiment, maintained. In another exemplary embodiment, during the forming process of a can end 12, the original thickness is generally reduced, or, the thickness of selected portions thereof are reduced. Whether the same as the original thickness or reduced from the original thickness, the elements of the can end 12 begin with a material with a decreased original thickness, as defined above, and end with a final thickness. That is, in an exemplary embodiment, each of the center panel 14, the annular portion 16, the chuck wall 18, and the curl 20 have originally have a decreased original thickness and end with a final thickness. In an exemplary embodiment, i.e., the decreased original thickness, and/or final thickness, is between about 0.0050 inch or 0.0096 inch, or is about 0.0079 inch. Using a can end 12, i.e., a decreased original thickness can end 12, solves the problems noted above.

Figure 9:
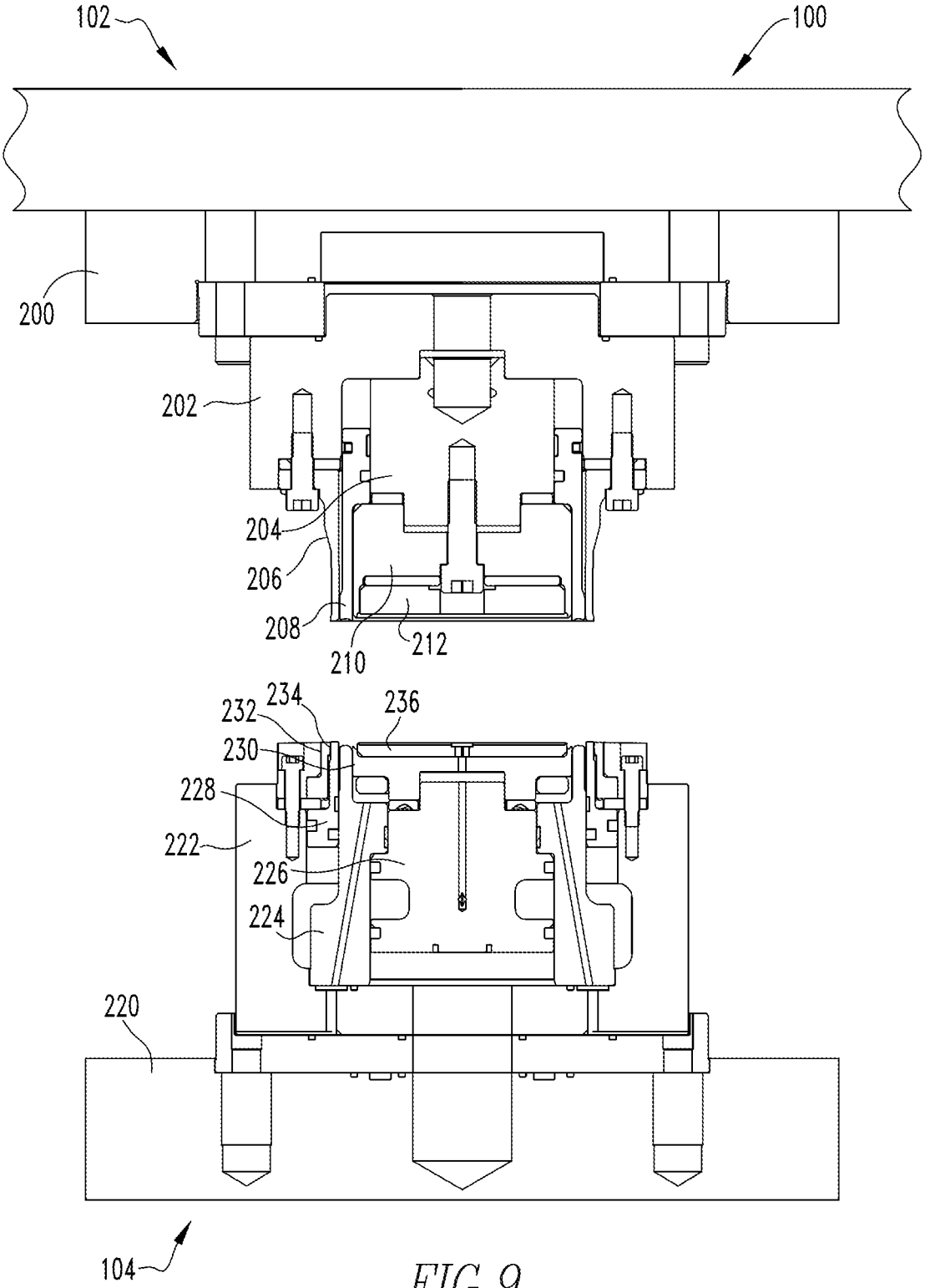
FIG. 9 is a cross-sectional view of a tooling assembly structured to form a can end.
Figure 9A:
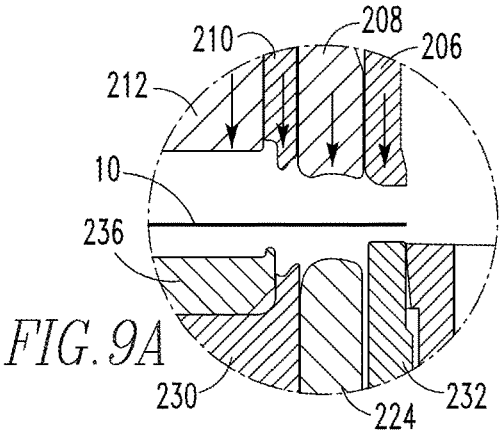
FIGS. 9A-9G show the progression of the tooling assembly as the upper tool assembly moves from the first position to the second position.
Figure 9B:
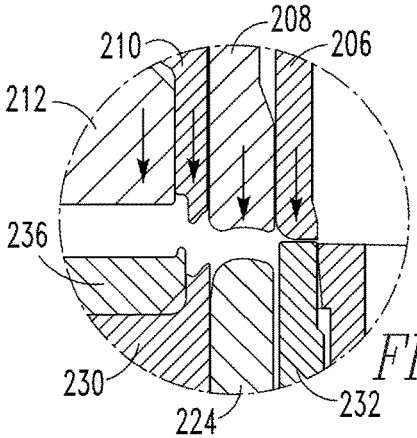
Figure 9C:
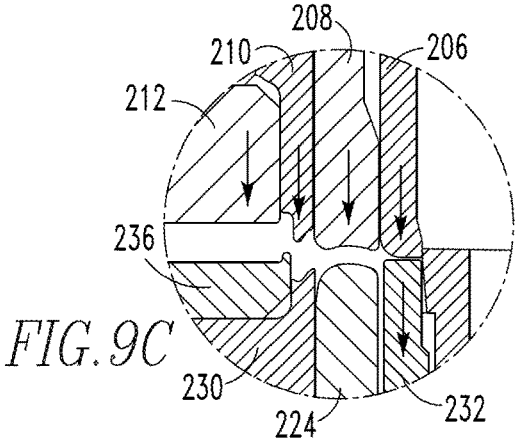
Figure 9D:
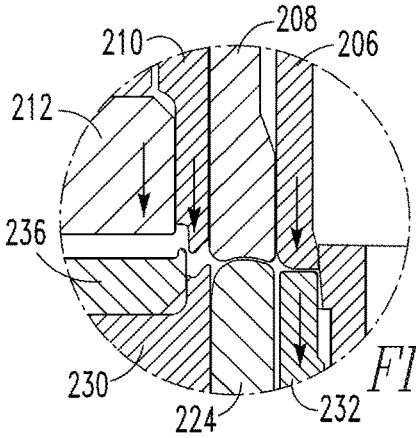
Figure 9E:
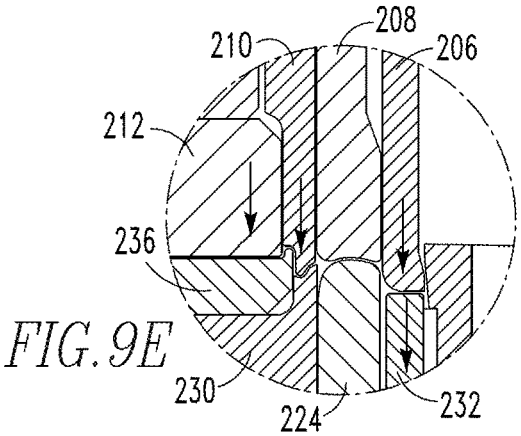
Figure 9F:
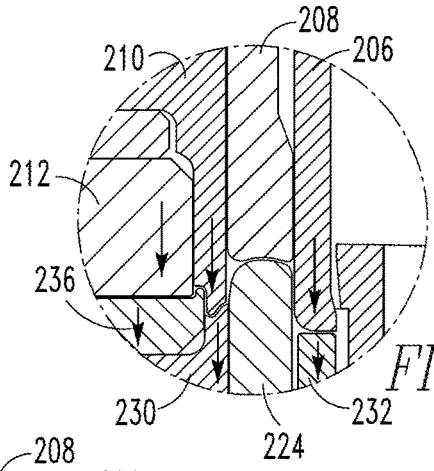
Figure 9G:
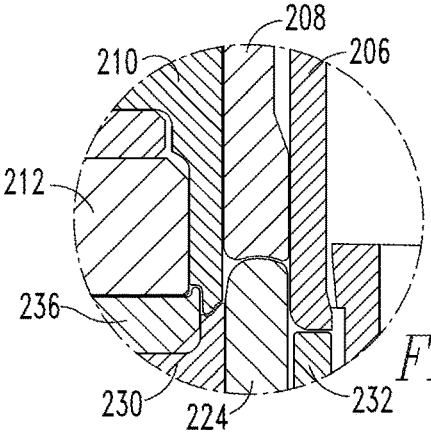

The can end 12 described above is formed in a tooling 100, or tooling assembly 100, as shown in FIG. 9. The tooling 100 includes an upper tool assembly 102 and a lower tool assembly 104. The upper tool assembly 102 and the lower tool assembly 104 cooperate to form material disposed therebetween into a can end 12 as described above. That is, the upper tool assembly 102 and the lower tool assembly 104 cooperate to form the annular portion 16 with an annular ridge 50 and an annular countersink 52, as described above. That is, the upper tool assembly 102 and the lower tool assembly 104 cooperate to form the annular ridge 50 substantially disposed above the original plane, and to form the annular countersink 52 substantially disposed below the original plane. In an exemplary embodiment, the upper tool assembly 102 and the lower tool assembly 104 cooperate to form the annular ridge with a generally arcuate cross-section, and, to form the annular countersink 52 with a generally arcuate cross-section.

In an exemplary embodiment, as shown in FIG. 9, the upper tool assembly 102 includes an upper die shoe 200, an upper tooling retainer 202, a die center riser 204, a "blank and draw" die punch 206, that is, element 206 is a single element that both cuts the blank from the sheet material and draws the blank, an upper piston 208, a die center punch 210, and, for the embodiment with a reverse panel, an upper reverse panel insert 212. In the same exemplary embodiment, the lower tool assembly 104 includes a lower die shoe 220, a lower tooling retainer 222, a die core ring 224, a panel punch piston 226, a lower piston 228, a panel punch 230, a cutting ring 232 with a cut edge 234, and a lower reverse panel insert 236. The interaction of these elements are shown sequentially in FIGS. 9A-9G. It is noted that, for clarity, a blank 10 is not shown in FIGS. 9B-9G, but is shown schematically in FIG. 9A. The motion of these elements are generally disclosed in U.S. Pat. No. 5,857,374 and the discussion associated with FIGS. 2-13 of that patent are incorporated by reference with the understanding that the upper reverse panel insert 212 moves with the die center punch 210 (die center 52 in U.S. Pat. No. 5,857,374) and the lower reverse panel insert 236 moves with the panel punch 230 (element 125 in U.S. Pat. No. 5,857,374).

Figure 10:
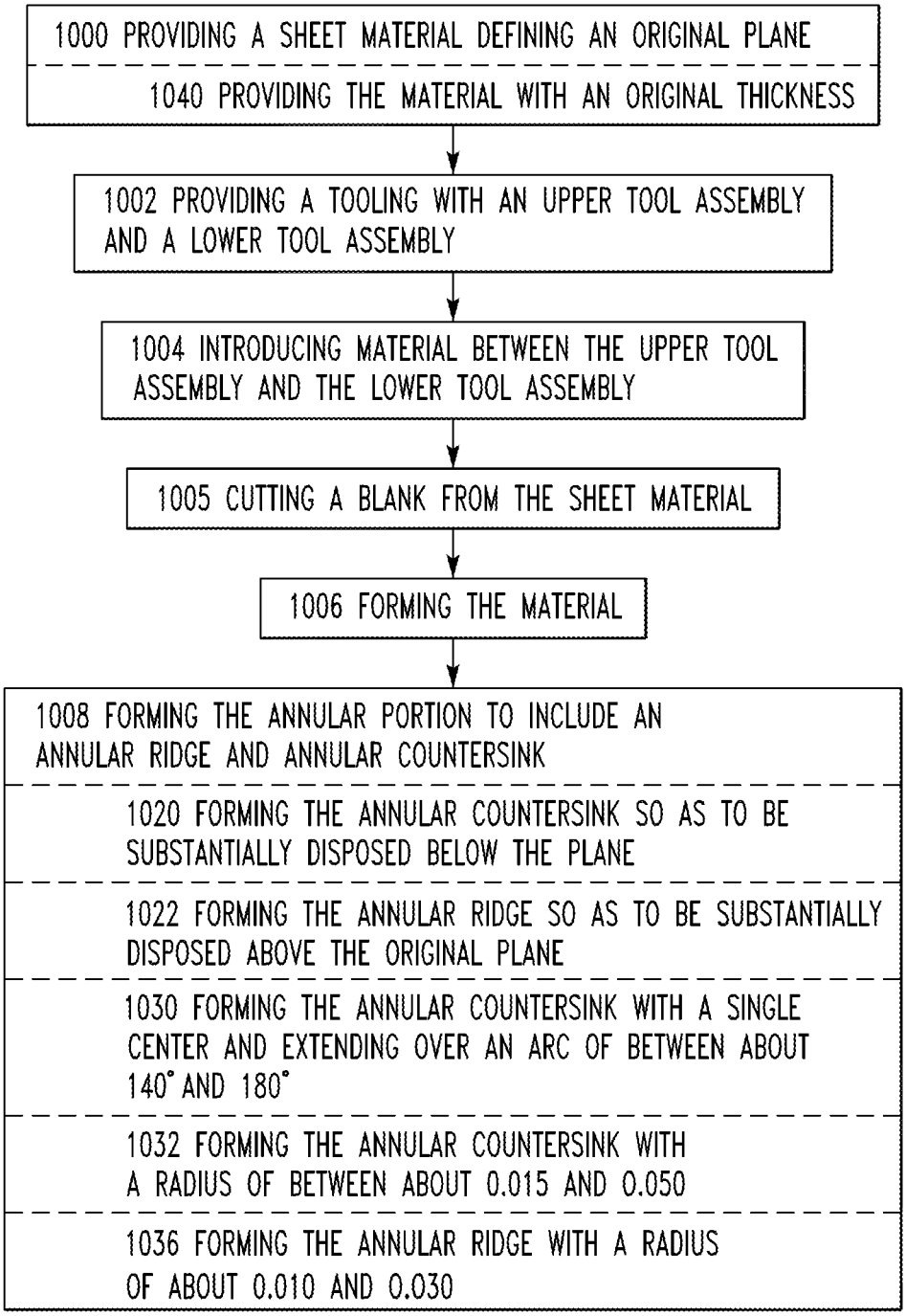
FIG. 10 is a flow chart for a disclosed method.

Accordingly, as shown in FIG. 10, a method of making a can end 12 with an annular ridge 50 and an annular countersink 52 includes: providing 1000 a sheet material defining an original plane, providing 1002 a tooling 100 with an upper tool assembly 102 and a lower tool assembly 104, introducing 1004 material between the upper tool assembly 102 and the lower tool assembly 104, cutting 1005 a blank 10 from the sheet material, forming 1006 the material, or the blank 10, to include a center panel 14, an annular portion 16 disposed about the center panel 14, a chuck wall 18 disposed about the annular portion 16, and a curl 20 extending radially outwardly from the chuck wall 18 (hereinafter "forming 1006 the material"), and, forming 1008 the annular portion 16 to include an annular ridge 50 and an annular countersink 52. In an exemplary embodiment, forming 1008 the annular portion 16 to include an annular ridge 50 and an annular countersink 52 includes forming 1020 the annular countersink 52 so as to be substantially disposed below the original plane, and, forming 1022 the annular ridge 50 so as to be substantially disposed above the original plane. Further, in an exemplary embodiment, forming 1008 the annular portion 16 to include an annular ridge 50 and an annular countersink 52 includes forming 1030 the annular countersink 52 with a single center and extending over an arc of between about 140° and 180°, forming 1032 the annular countersink 52 with a radius of between about 0.015 inch and 0.050 inch or about 0.020 inch, forming 1034 the annular ridge 50 with a single center and extending over an arc of between about 140° and 180°, or in one embodiment an arc of about 150°, or, in another embodiment, and arc of about 160° and forming 1036 the annular ridge 50 with a radius of between about 0.010 inch and 0.030 inch, or about 0.015 inch.

In another exemplary embodiment, providing 1000 a sheet material defining an original plane includes providing 1040 the material with a decreased original thickness, wherein the decreased original thickness is between about 0.0055 inch and 0.0110 inch, between about 0.0050 inch and 0.0096 inch, or about 0.0079 inch, wherein after forming 1006 the material to include a center panel 14, an annular portion 16, a chuck wall 18, and a curl 20, each of the center panel 14, the annular portion 16, the chuck wall 18, and the curl 20 have a final thickness, and wherein, the final thickness is substantially the same as the decreased original thickness, i.e., between about 0.0055 inch and 0.0110 inch, between about 0.0050 inch and 0.0096 inch, or about 0.0079 inch.

Figure 11:
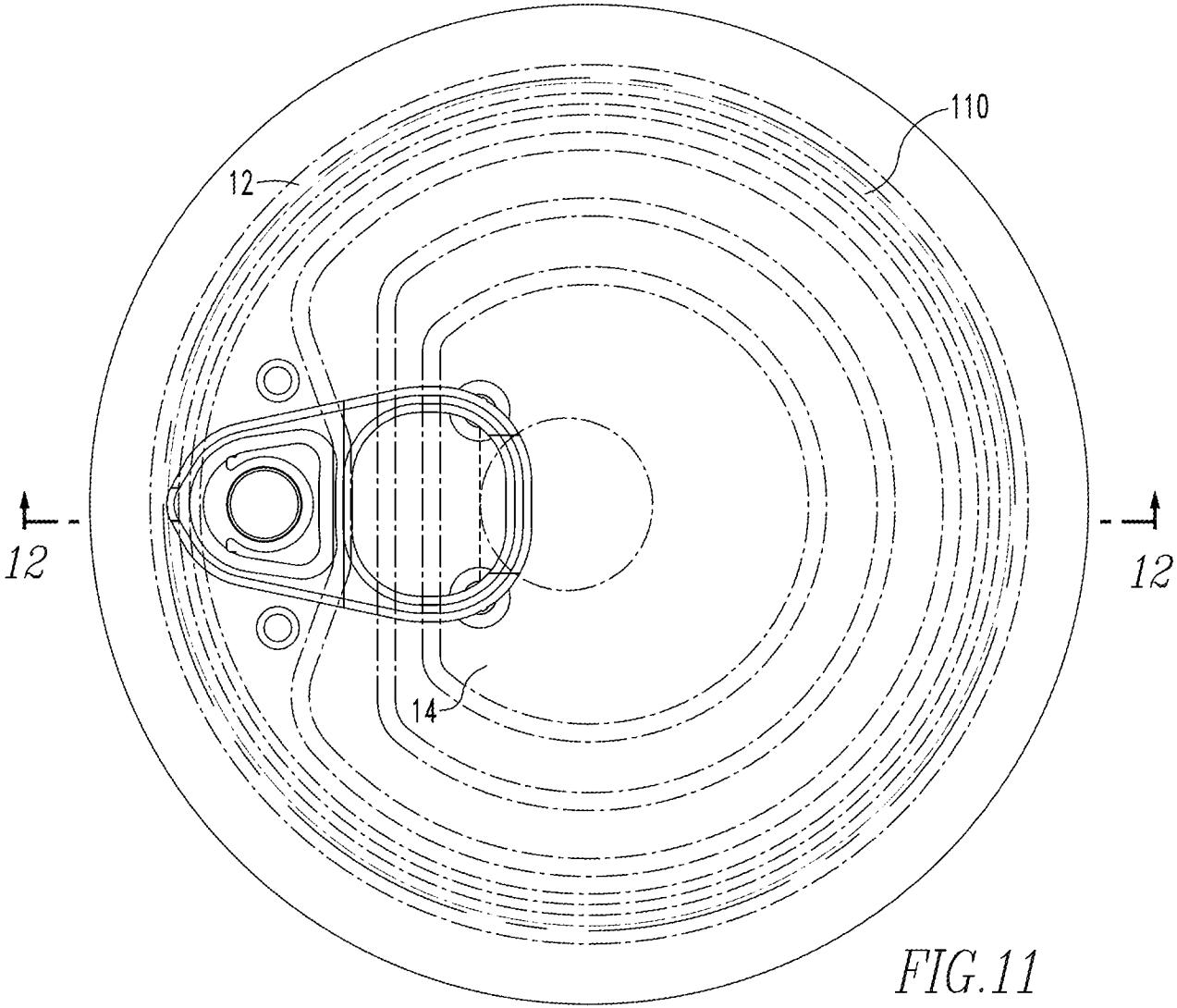
FIG. 11 is a top view of another embodiment of a can end.
Figure 12:
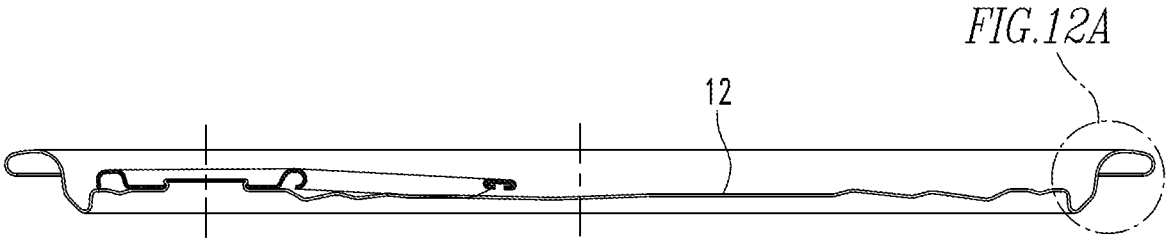
FIG. 12 is a cross-sectional view of a can end of FIG. 11.
Figure 12A:
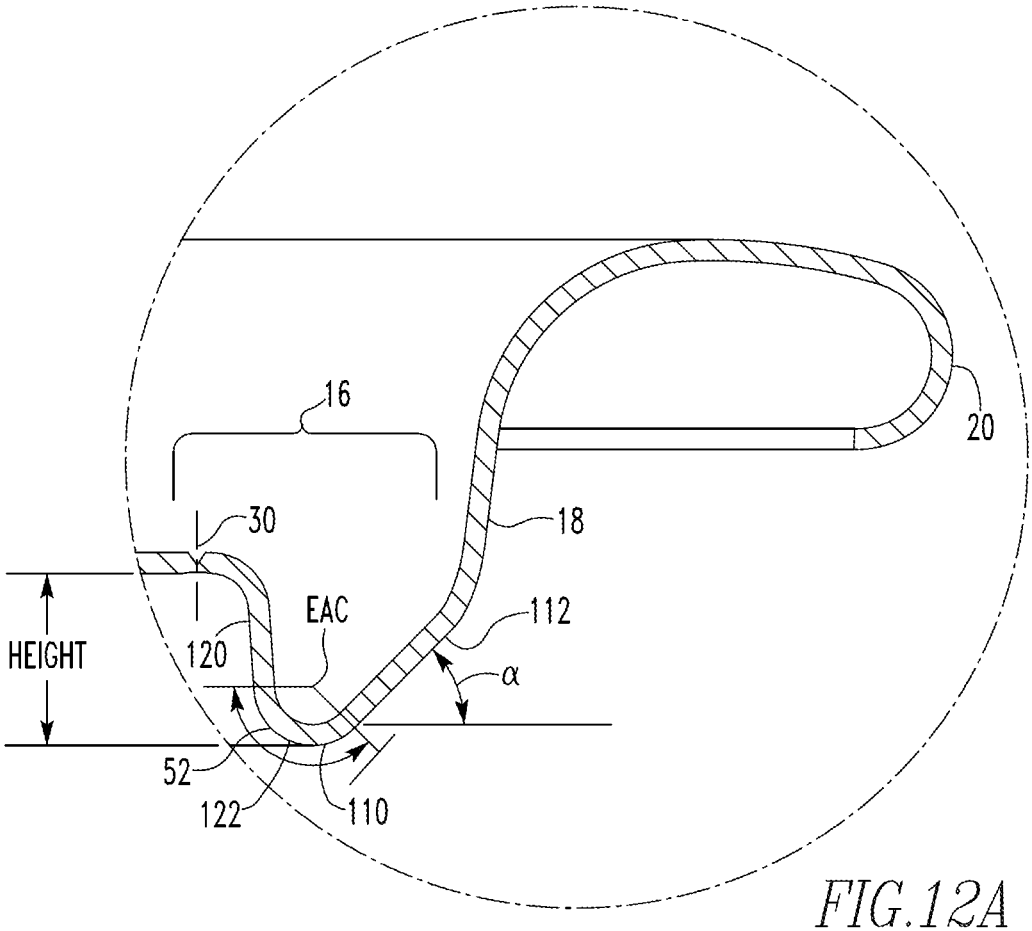
FIG. 12A is a detail view of a can end of FIG. 12.
Figure 13:
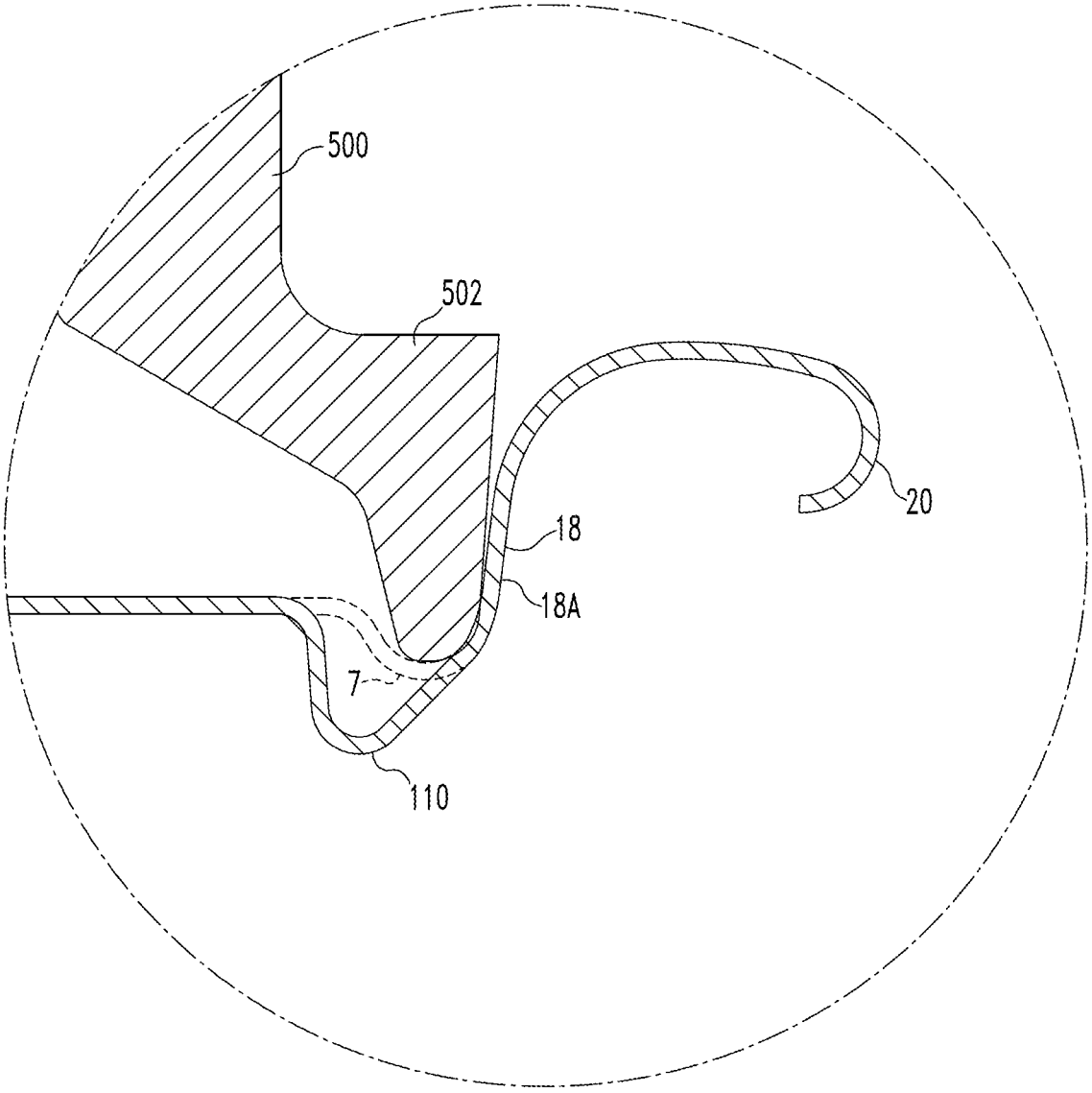
FIG. 13 is a partially schematic, detail cross-sectional view comparing an enhanced annular countersink to a prior art annular countersink.

In another exemplary embodiment, shown in FIGS. 11 and 12, the down-gauging construct 11 includes an enhanced annular countersink 110 and/or an annular tapered portion 112. That is, in this embodiment, the annular portion 16 includes an enhanced annular countersink 110 and/or an annular tapered portion 112. As used herein, an "enhanced annular countersink" means a countersink that is part of a can end 12 wherein the panel depth is between about eight and nine times the center panel 14 final thickness. Further, an "enhanced annular countersink" means that the countersink does not begin and end in the same general plane. Instead, and "enhanced annular countersink" 110 includes a curvilinear portion 122 (discussed below), or arcuate portion, of between about 115° and 160°, or about 135° (shown by line "EAC" in FIG. 12A). Further, as used herein, an "enhanced annular countersink" is radially wider than a standard seam chuck 502, discussed below. That is, as shown in FIG. 13, a prior art annular countersink 7 (in ghost) has generally the same radial width as a standard seam chuck 502. The enhanced annular countersink 110, however, has a radial width that is substantially wider than a standard seam chuck 502.

In an exemplary embodiment, the annular planar portion 54 is an "enhanced annular planar portion" 120 disposed between the center panel 14 and the annular countersink 52. As used herein, an "enhanced annular planar portion" means that the annular planar portion 54 has a height (as shown in FIG. 12A, i.e., a distance measured normal to the plane of the center panel 14) of between about eight and nine times the center panel 14 final thickness. In this configuration, the annular countersink 52 has a depth, as measured from the bottom of the annular countersink 52 to the bottom of the center panel 14, that is greater than the depth of an annular countersink on a prior art can end 12. This solves the problems stated above. Further, in an exemplary embodiment, the enhanced annular planar portion 120 extends generally perpendicular to the plane of the center panel 14.

In an exemplary embodiment, the enhanced annular planar portion 120 is disposed immediately adjacent the center panel 14 and extends about the center panel 14. Further, the enhanced annular countersink 110 is disposed immediately adjacent the enhanced annular planar portion 120 and extends about the enhanced annular planar portion 120. The enhanced annular countersink 110 is generally curvilinear, or generally arcuate, when viewed in cross-section, as shown in FIG. 12A and is identified hereinafter as a generally curvilinear portion 122. The enhanced annular countersink 110, or stated alternately the generally curvilinear portion 122, extends between about 115° and 160°, or about 135°. In an exemplary embodiment, the generally curvilinear portion 122 is generally arcuate. Further, the generally curvilinear portion 122 has a radius or between about 0.015 inch and 0.050 inch, or about 0.020 inch.

In an exemplary embodiment, the enhanced annular countersink 110 is encircled, or surrounded by the annular tapered portion 112. That is, the annular tapered portion 112 is disposed immediately adjacent, and extends about, the enhanced annular countersink 110. As used herein, an "annular tapered portion" is angled, i.e., is not generally perpendicular or generally parallel to the plane of the center panel 14. As shown, the annular tapered portion 112 is angled (as shown by angle $\alpha$) between about 25° and 50° relative to the plane of the center panel 14 (which is also the original plane or parallel to the original plane). As used herein, an angle of between about 25° and 50° is not generally perpendicular or generally parallel to a reference plane. In this embodiment, the annular tapered portion 112 is generally straight (when viewed in cross-section as shown) and is, as used herein, a "straight annular tapered portion" 112. That is, as used herein, a "straight annular tapered portion" 112 means an annular tapered portion 112 that does not include a "step," as defined below, or a similar variation, e.g., a double step, in the annular tapered portion 112.

Further, as used herein, an "annular tapered portion" is angled upwardly and outwardly. That is, the end of the annular tapered portion 112 adjacent the enhanced annular countersink 110 has a smaller radius relative to the end of the annular tapered portion 112 adjacent the chuck wall 18, and, the end of the annular tapered portion 112 adjacent the enhanced annular countersink 110 has a greater offset (i.e., distance normal to the plane of the center panel 14) relative to the end of the annular tapered portion 112 adjacent the chuck wall 18. In an exemplary embodiment, the annular tapered portion 112 has a radial width of between about six and eight times the center panel final thickness. As used herein, a "radial width" means the distance measured generally parallel to the plane of the center panel 14.

Figure 14:
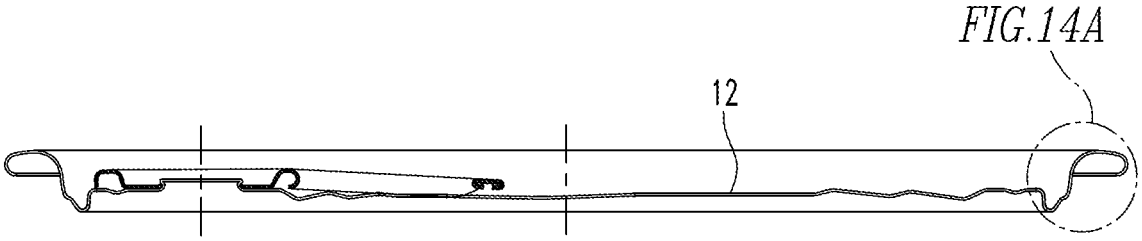
FIG. 14 is a cross-sectional view of another embodiment of a can end.
Figure 14A:
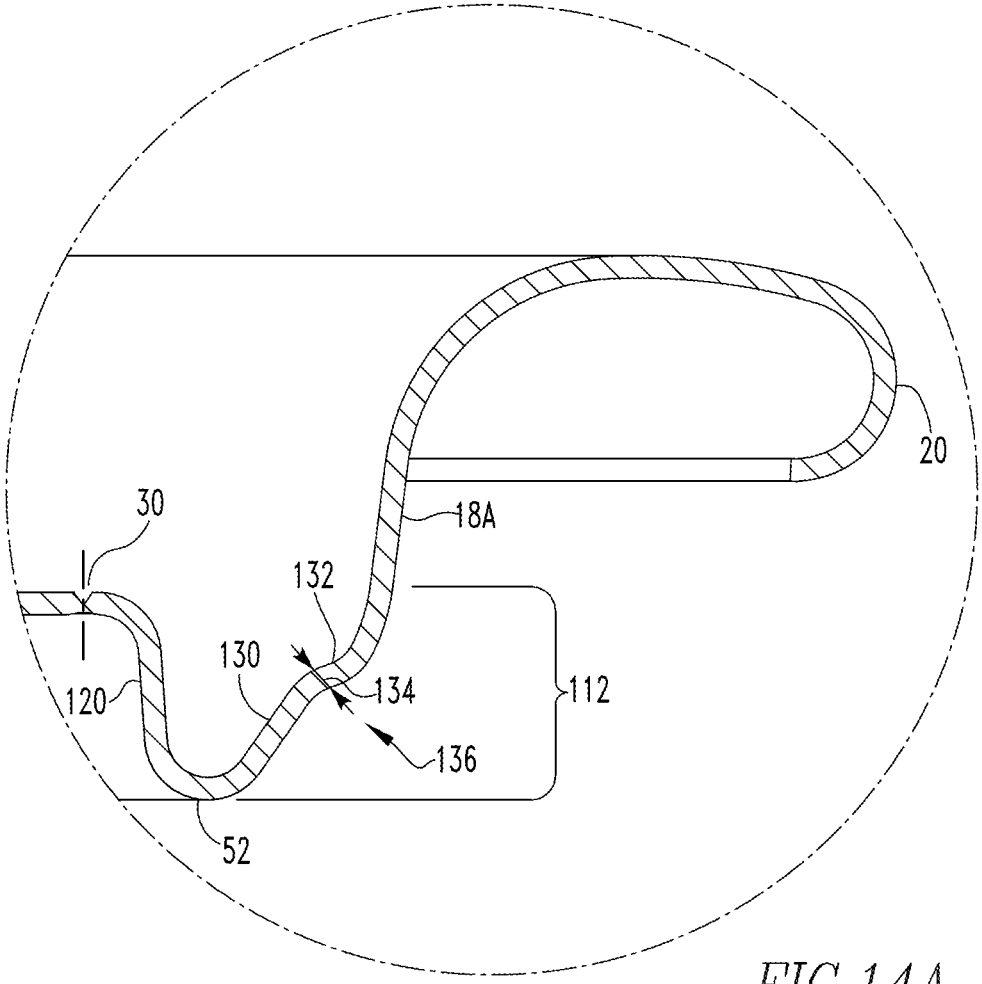
FIG. 14A is a detail view of another embodiment of a can end.
Figure 14B:
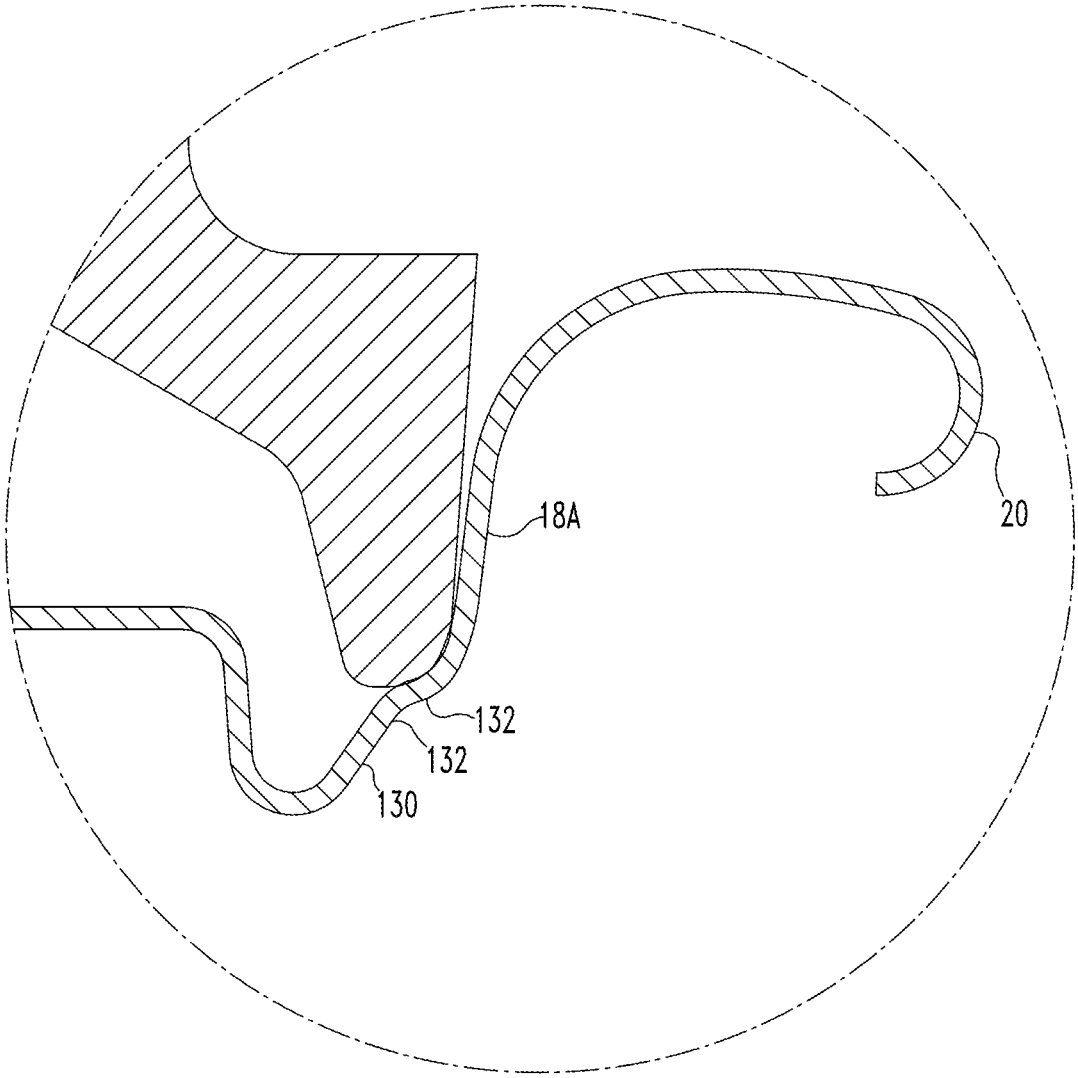
FIG. 14B is a schematic cross-sectional side view of the can end of FIG. 14 engaged by a reamer.

In another exemplary embodiment, as shown in FIGS. 14, 14A and 14B, an annular tapered portion 112A includes a first section 130 and a second section 132. The annular tapered portion first section 130 is disposed about, and immediately adjacent to, the enhanced annular countersink 110. The annular tapered portion second section 132 is disposed about, and immediately adjacent to, the annular tapered portion first section 130. The annular tapered portion first section 130 is angled between about 35° and 65°, or about 55°, to the plane of the center panel 14. The annular tapered portion second section 132 is angled between about 15° and 30°, or about 20°, to the plane of the center panel 14. In this configuration, an interface 134 between the annular tapered portion first section 130 and the annular tapered portion second section 132 defines a "step" 136 as viewed in cross-section. As used herein, a "step" is an area of transition between two planes. In this embodiment, the annular tapered portion 112A is, as used herein, a "stepped annular tapered portion" 112A. That is, as used herein, a "stepped annular tapered portion" 112A means an annular tapered portion 112, as described above, that also includes a "step."

The step 136, as well as a "standard chuck wall" 18A above the step 136, is structured to be, and is, engaged by a standard seam chuck 502, as shown in FIG. 14B. As used herein, a "standard chuck wall" is a chuck wall 1S structured to be engaged by a seam chuck structured to seam prior art can ends and is the same, or substantially the same, as the prior art chuck wall 18A (FIG. 2). Further, in an exemplary embodiment, the annular tapered portion first section 130 has a height of between about 0.040 inch and 0.085 inch, and, the annular tapered portion second section 132 has a height of between about 0.010 inch and 0.030 inch.

In an exemplary embodiment, the chuck wall 18 is a "standard" chuck wall 18A. As used herein, a "standard" chuck wall 18A is structured to be engaged by a standard seam chuck 502. That is, containers 70 generally have a standard size such as, but not limited to, a 12 oz. beverage container (not shown). Food and beverage producers obtain can ends 12 and can bodies 60 from different manufacturers that are processed in a seaming press 500, discussed below. For the can ends 12 and can bodies 60 to be processed, they must be a standard size. Thus, as used herein, a "standard" chuck wall 18A means a chuck wall that is structured to be, and is, engaged by a standard seam chuck 502 for a common container size known in the art. Further, a "standard seam chuck" means a seam chuck structured to seam a common prior art shell or can end 1. It is understood that different size containers are associated with different sized seam chucks; thus, a "standard seam chuck" means a seam chuck that is associated with a specific size container. Stated alternately, and as example only, a 12 ounce beverage container has a "standard seam chuck" of one size but a 3.5 ounce sardine container has a "standard seam chuck" of a different size.

As before, the standard chuck wall 18A is disposed about, and immediately adjacent, the annular countersink 52. The curl 20 is disposed about, and immediately adjacent, the standard chuck wall 18A. That is, the curl 20 extends radially outwardly from the standard chuck wall 18A. As is known, the can end 12 is coupled, directly coupled, or fixed to a can body 60 thereby forming a container 70.

In another exemplary embodiment, the annular portion 16 includes each, or any combination of, an annular ridge 50, an enhanced annular countersink 110 and annular tapered portion 112, each as described above. Stated alternately, a can end 12 down-gauging construct 11 includes an annular ridge 50, an enhanced annular countersink 110 and annular tapered portion 112. The use of these down-gauging construct(s) 11 solve the problems noted above whereby the original, as well as the final thickness, of the can end 12 is reduced relative to the known art.

A can end 12 having an enhanced annular countersink 110 and/or an annular tapered portion 112 is formed in a tooling 100 as generally described above. It is additionally noted that to form the enhanced annular countersink 110 and/or annular tapered portion 112 the upper tool assembly 102 and the lower tool assembly 104 are structured to cooperate to form material disposed therebetween into a can end 12, the can end 12 including a center panel 14, an annular portion 16 disposed about the center panel 14, a standard chuck wall 18A disposed about the annular portion 16, and a curl 20 extending radially outwardly from the standard chuck wall 18A.

In an exemplary embodiment, the upper tool assembly 102 and the lower tool assembly 104 are substantially similar to the tooling assembly of U.S. Pat. No. 5,857,374 except that the contour of the outer periphery of the die center (element 52 of U.S. Pat. No. 5,857,374) is shaped to substantially correspond to the enhanced annular countersink 110 as described above as well as either the straight annular tapered portion 112 or the stepped annular tapered portion 112A. That is, the upper tool assembly 102 includes a punch structured to form an enhanced annular countersink as defined above.

In an exemplary embodiment, the upper tool assembly 102 and the lower tool assembly 104 are structured to form an enhanced annular planar portion 120 extending generally perpendicular to the plane of the center panel 14. Further, the upper tool assembly 102 and the lower tool assembly 104 are structured to form, and do form, the annular tapered portion 112 to be angled between about 25° and 50° to the plane of the center panel 14, and, the upper tool assembly 102 and the lower tool assembly 104 are structured to form, and do form, the annular tapered portion 112 with a radial width of between about six and eight times the center panel final thickness. The can ends 12 are subsequently processed by a seaming assembly which includes a standard seam chuck 502 as is known.

Figure 15:
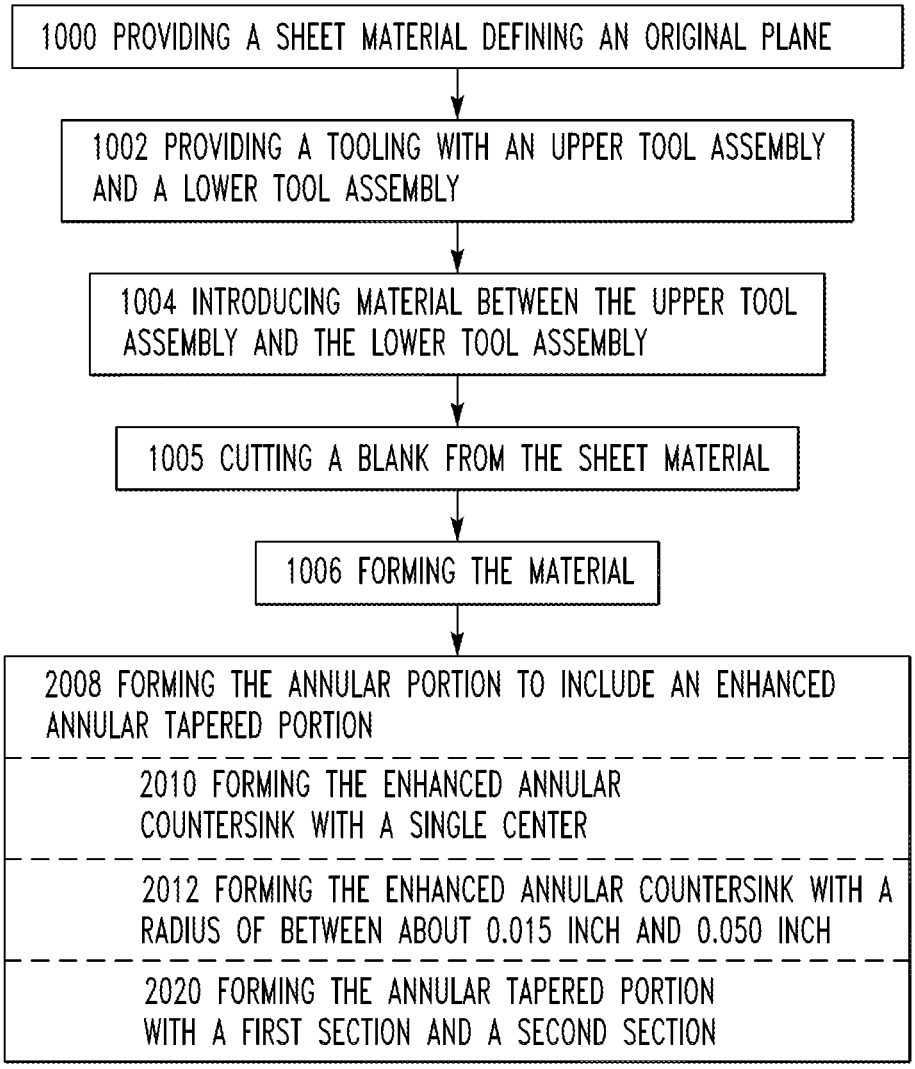
FIG. 15 is a flow chart for a disclosed method.

Accordingly, as shown in FIG. 15, a method of making a can end 12 with an enhanced annular countersink 110 and/or an annular tapered portion 112 includes, providing 1000 a sheet material defining an original plane, providing 1002 a tooling 100 with an upper tool assembly 102 and a lower tool assembly 104, introducing 1004 material between the upper tool assembly 102 and the lower tool assembly 104 (as described above), cutting 1005 a blank 10 from the sheet material, as well as, forming 1006 the material to include a center panel 14, an annular portion 16 disposed about the center panel 14, a standard chuck wall 18A disposed about the annular portion 16, and a curl 20 extending radially outwardly from the standard chuck wall 18A, forming 2008 the annular portion 16 to include an enhanced annular countersink 110 and an annular tapered portion 112 wherein the annular tapered portion 112 is disposed about the enhanced annular countersink 110.

Further, forming 2008 the annular portion 16 to include an enhanced annular countersink 110 and an annular tapered portion 112 includes, forming 2010 the enhanced annular countersink 110 with a single center and extending over an arc of between about 115° and 160°, or about 135°, forming 2012 the enhanced annular countersink 110 with a radius of between about 0.015 inch and 0.050 inch, or about 0.020 inch, forming a straight annular tapered portion 112 with an angle of between about 25° and 50° relative to the original plane. Further, forming 2008 the annular portion 16 to include an enhanced annular countersink 110 and a stepped annular tapered portion 112A includes, forming 2020 the annular tapered portion 112 with a first section 130 and a second section 132, the annular tapered portion first section 130 disposed about the enhanced annular countersink 110, the annular tapered portion second section 132 disposed about the annular tapered portion first section 130, the annular tapered portion first section 130 angled between about 35° and 65° to the plane of the center panel 14, the annular tapered portion second section 132 angled between about 15° and 30° to the plane of the center panel 14.

Figure 16:
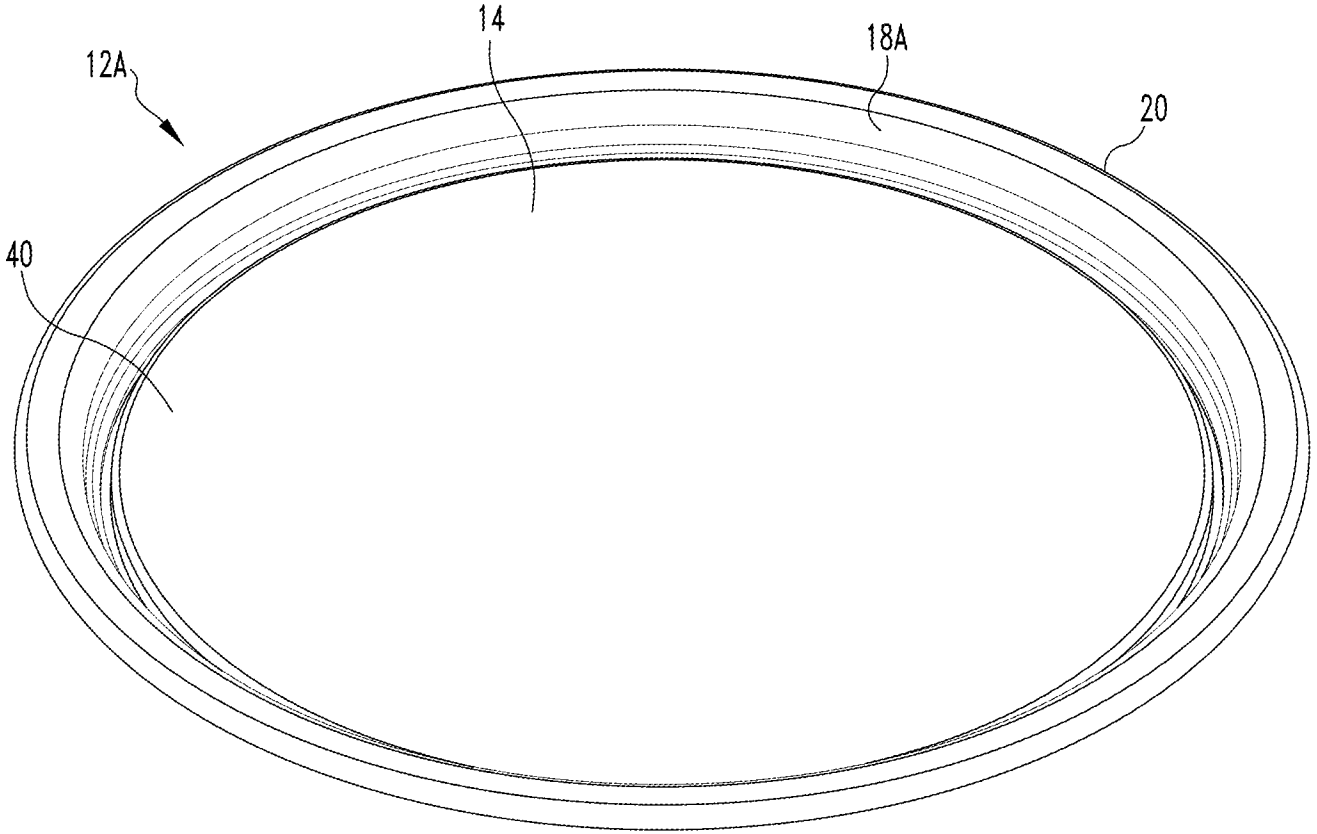
FIG. 16 is an isometric top view of another embodiment of a can end.
Figure 17:
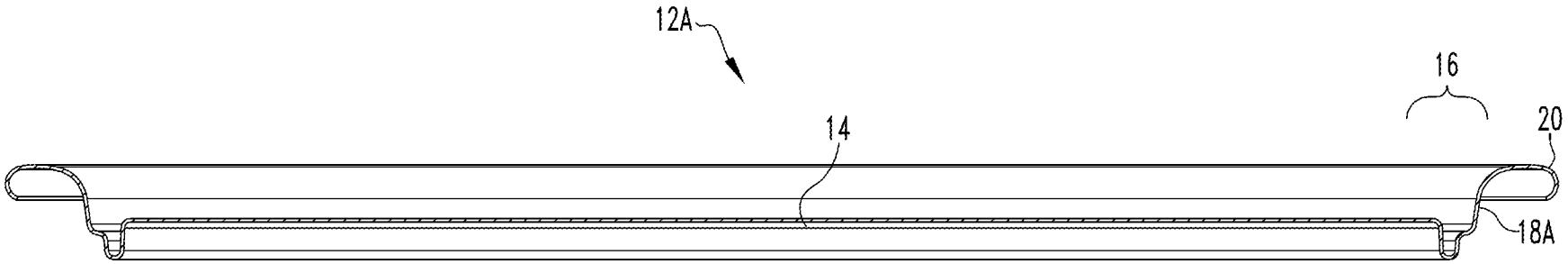
FIG. 17 is a cross-sectional view of a can end of FIG. 16.
Figure 18:
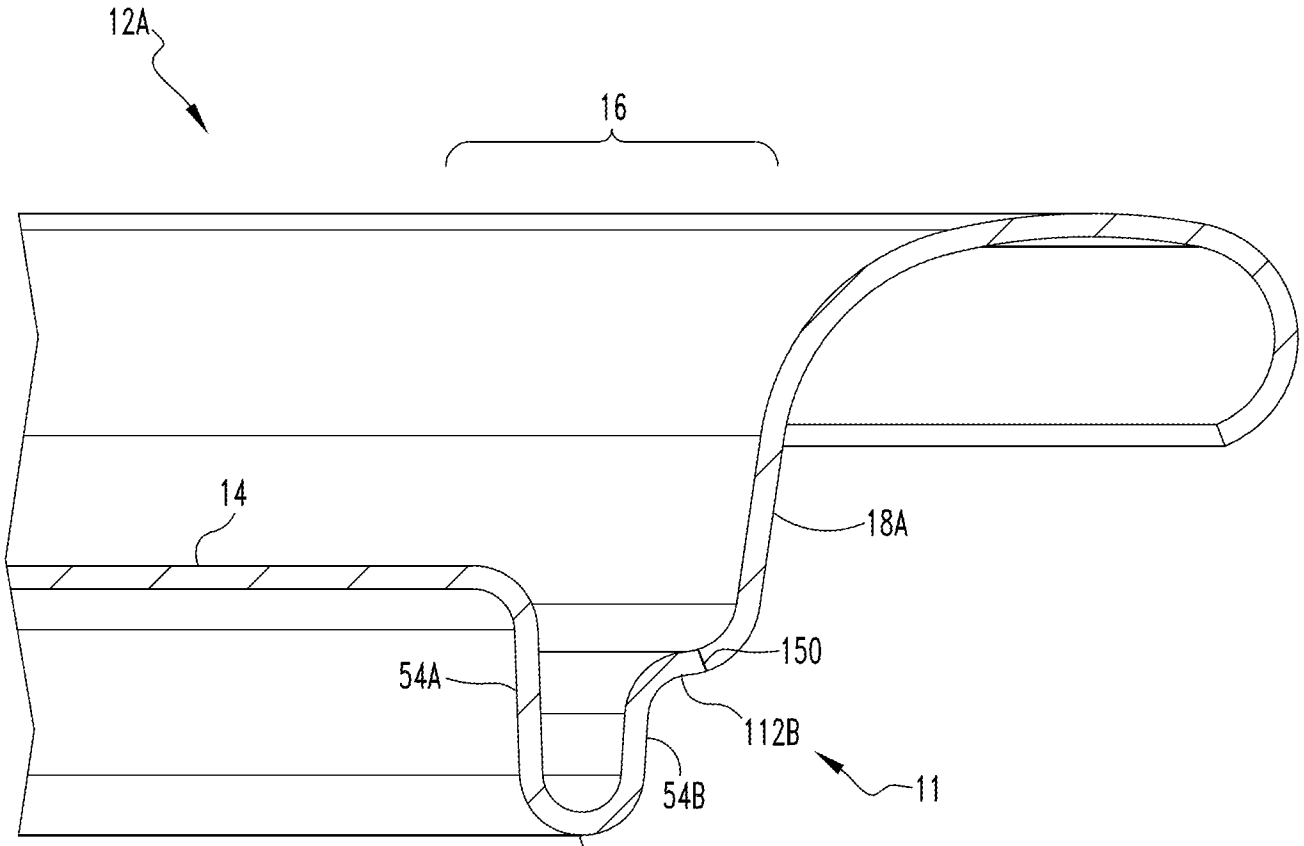
FIG. 18 is a detail cross-sectional view of a can end of FIG. 16.

In another embodiment, shown in FIGS. 16-18, a can end 12A having a down-gauging construct 11 includes a "subsurface step" 150 and is formed from a blank 10A having an "enhanced diameter" as well as a "decreased original thickness." As noted above, for each specific type, model, and/or style of can and/or can end there is an "established thickness." Similarly, for each specific type, model, and/or style of can and/or can end there is an "established blank size." As used herein, an "established blank size" means a blank having an original diameter for a given type, model, and/or style of can and/or can end which is well known in the art. Further, as used herein, a blank 10A with an "enhanced diameter" means a blank 10A that is formed into a can end 12A sized to correspond to a known can end for a specific type, model, and/or style of can wherein the diameter of the blank is larger than the "established blank size." Further, as used herein, an "enhanced can end" 12A, or an "enhanced can end body" 40A, means a can end 12A, or can end body 40A, formed from a blank having an "enhanced diameter." That is, as used herein, an "enhanced can end" 12A, or an "enhanced can end body" 40A, means a can end or can end body wherein the blank 10A used to form the "enhanced can end" 12A, or "enhanced can end body" 40A, was a blank 10A with an "enhanced diameter" and does not mean a product by process.

Further, as a specific can end, i.e., each specific type, model, and/or style of can end, has an "established thickness" and an "established blank size," i.e., diameter, each specific can end has an "established volume." That is, the blank used to form a specific can end has an "established volume." A blank 10A used to form an enhanced can end 12A utilizing a down-gauging construct 11 has a "reduced volume." That is, as used herein, a "reduced volume" blank 10A means a blank having a volume that is less than the "established volume" for a specific type, model, and/or style of can end while also having a larger diameter for the "established blank size." Further, a "reduced volume" can end 12A means a can end 12A that is formed from a "reduced volume" blank 10A. That is, as used herein, the term "reduced volume" can end 12A relates to the volume, i.e., the structure, of the can end 12A and does not mean a product by process. Similarly, a "reduced volume" can end body 40A means a can body 40A that is formed from a "reduced volume" blank 10A. That is, as used herein, the term "reduced volume" can end body 40A relates to the volume, i.e., the structure, of the can end body 40A and does not mean a product by process.

Further, as used herein, a "subsurface step" means a "step" in a can end annular portion 16 that is disposed below the plane of the upper surface, or product side, of the center panel 14. Further, in an exemplary embodiment, the "subsurface step" 150 is disposed within, or immediately adjacent, an "enhanced annular tapered portion" 112B and is identified herein as an "enhanced annular tapered portion subsurface step" 150. That is, an "enhanced annular tapered portion" means the portion of an annular portion 16 that is disposed about an annular countersink 7 and which has an upward angle of between about 0° and 30°, or about 5°, relative to the plane of the center panel 14 (which is also the original plane or parallel to the original plane). As shown, the "subsurface step" 150 is disposed between the enhanced annular tapered portion 112B and a standard chuck wall 18A; as used herein, this configuration is a "standard chuck, subsurface step." Further, in an exemplary embodiment, the "subsurface step" 150 is disposed adjacent, or immediately adjacent, a "boxed" annular countersink 52A. As used herein, a "boxed" annular countersink 52A means a countersink 52 which is disposed between a first annular planar portion 54A and a second annular planar portion 54B wherein the first annular planar portion 54A and the second annular planar portion 54B are both substantially perpendicular to the plane of the center panel 14. As used herein, a "subsurface step" 150 disposed adjacent, or immediately adjacent, a "boxed" annular countersink 52 is a "supra" subsurface step 150. Thus, a subsurface step 150 disposed between a "boxed" annular countersink 52A and a standard chuck wall 18A is, as used herein, a "standard chuck, supra subsurface step" 150.

That is, as shown in FIG. 16, in this embodiment, a can end 12A includes a body 40 having a center panel 14, an annular portion 16, a chuck wall 18 and a curl 20, as described above. The can end body 40 is an enhanced can end body and the can end 12A is an enhanced can end. That is, the can end 12A is initially a blank 10 with an "enhanced diameter." Further, the can end 12A, and therefore the can end body 40, has a decreased original thickness.

Further, in this embodiment, the annular portion 16 includes a first annular planar portion 54A, an annular countersink 52, second annular planar portion 54B, an enhanced annular tapered portion 112B and a subsurface step 150. In an exemplary embodiment, the first annular planar portion 54A extends in a plane that is substantially perpendicular to the plane of the center panel 14. Similarly, the second annular planar portion 54B extends in a plane that is substantially perpendicular to the plane of the center panel 14. The annular countersink 52 is disposed between the first annular planar portion 54A and the second annular planar portion 54B and, as such, is a "boxed" annular countersink 52A as defined above. Thus, the annular countersink 52 extends about the first annular planar portion 54A and the second annular planar portion 54B extends about the annular countersink 52. Further, and in an exemplary embodiment, the annular countersink 52 is generally arcuate and extends over an arc of substantially 180 degrees. That is, the annular countersink 52 is substantially semicircular when viewed in cross-section as shown in FIG. 18.

The enhanced annular tapered portion 112B is similar to the annular tapered portion 112 described above, but has an angle of between about 0° and 30° or about 5° relative to the plane of the center panel 14. That is, as used herein, an "enhanced annular tapered portion" is similar to an "annular tapered portion" but the angle of the taper is between about 0° and 30° relative to the plane of the center panel 14. As used herein, a "specific enhanced annular tapered portion" is similar to an "annular tapered portion" but the angle of the taper is about 5° relative to the plane of the center panel 14.

The subsurface step 150 is disposed below the plane of the center panel 14 and, as shown, below the plane of the bottom surface of the center panel 14. The subsurface step 150 is disposed between the enhanced annular tapered portion 112B and the chuck wall 18. That is, the subsurface step 150 defined the transition from the enhanced annular tapered portion 112B to the chuck wall 18. In an exemplary embodiment, the chuck wall 18 is a standard chuck wall 18A as defined above. The standard chuck wall 18A is disposed about the annular portion 16 and immediately adjacent the subsurface step 150 and/or the enhanced annular tapered portion 112B.

As before, the can end 12A is structured to be, and is, coupled, directly coupled, fixed or seamed to a filled can body 60 thereby forming a container 70, as discussed above.

A can end 12A having a boxed annular countersink 52A and/or a subsurface step 150 is formed in a tooling 100 as generally described above. It is additionally noted that to form the boxed annular countersink 52A and/or a subsurface step 150 the upper tool assembly 102 and the lower tool assembly 104 are structured to cooperate to form material disposed therebetween into a can end 12A, the can end 12A including a center panel 14, an annular portion 16 disposed about the center panel 14, a standard chuck wall 18A disposed about the annular portion 16, and a curl 20 extending radially outwardly from the standard chuck wall 18A. Further, the upper tool assembly 102 and the lower tool assembly 104 are structured to cooperate to form material disposed therebetween into a first annular planar portion 54A, an annular countersink 52, a second annular planar portion 54B, an enhanced annular tapered portion 112B and a subsurface step 150.

In an exemplary embodiment, the upper tool assembly 102 and the lower tool assembly 104 are substantially similar to the tooling assembly of U.S. Pat. No. 5,857,374 except that the contour of the outer periphery of the die center (element 52 of U.S. Pat. No. 5,857,374) is shaped to substantially correspond to the boxed annular countersink 52A and/or a subsurface step 150 as described above. That is, the upper tool assembly 102 includes a punch structured to form a boxed annular countersink 52A and/or a subsurface step 150 as defined above. In an exemplary embodiment, the upper tool assembly 102 and the lower tool assembly 104 are further structured to form an enhanced annular tapered portion 112B. The can ends 12A are subsequently processed by a seaming assembly which includes a standard seam chuck 502 as is known.

Figure 19:
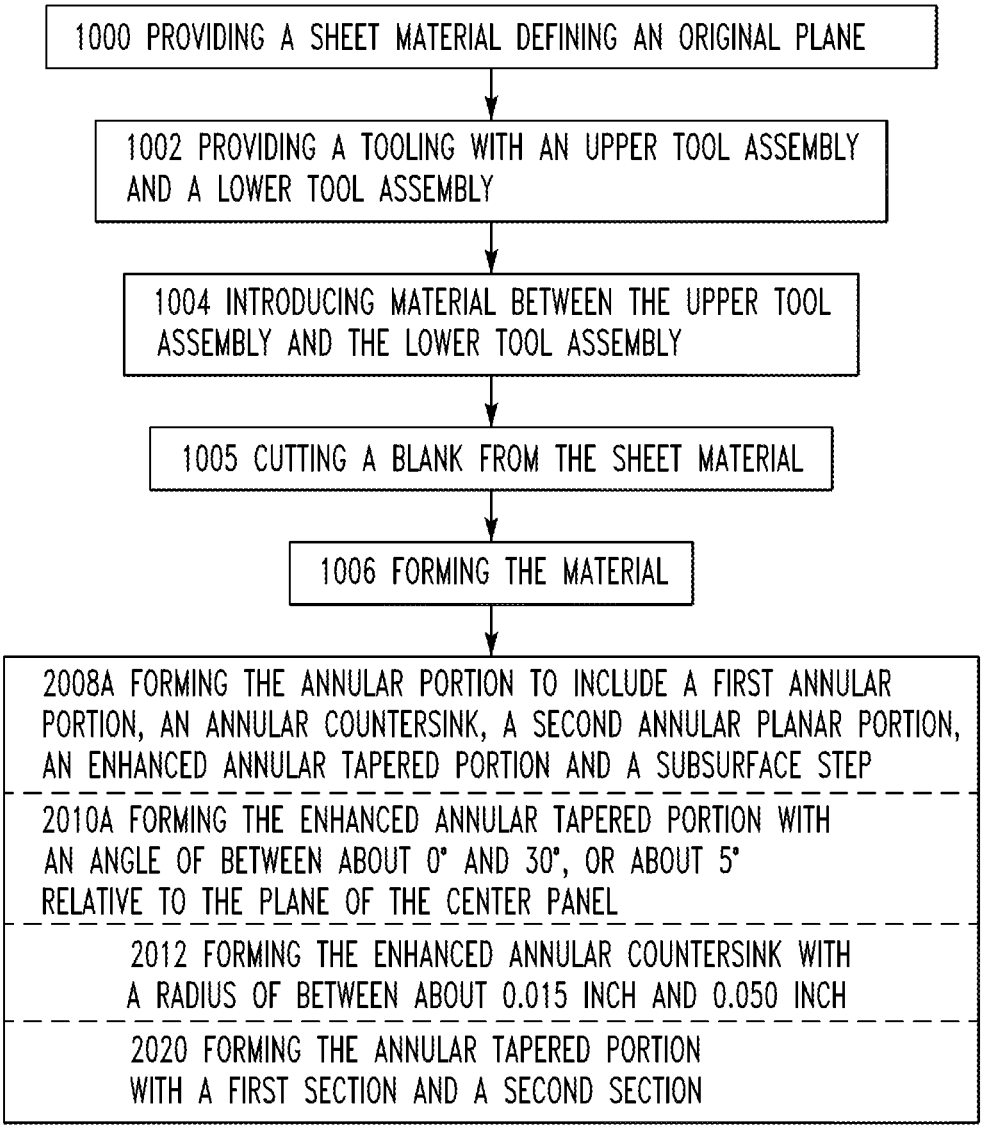
FIG. 19 is a flow chart for a disclosed method.

Further, as shown in FIG. 19, a method of making a can end 12A with a boxed annular countersink 52A and/or a subsurface step 150 includes, providing 1000 a sheet material defining an original plane, providing 1002 a tooling 100 with an upper tool assembly 102 and a lower tool assembly 104, introducing 1004 material between the upper tool assembly 102 and the lower tool assembly 104 (as described above), cutting 1005 a blank 10 from the sheet material, as well as, forming 1006 the material to include a center panel 14, an annular portion 16 disposed about the center panel 14, a standard chuck wall 18A disposed about the annular portion 16, and a curl 20 extending radially outwardly from the standard chuck wall 18A, forming 2008A the annular portion 16 to include a first annular planar portion 54A, an annular countersink 52, second annular planar portion 54B, an enhanced annular tapered portion 112B and a subsurface step 150. Further, forming 2008A the annular portion 16 to include a first annular planar portion 54A, an annular countersink 52, second annular planar portion 54B, an enhanced annular tapered portion 112B and a subsurface step 150 includes, forming 2010A the enhanced annular tapered portion 112B with an angle of between about 0° and 30° or about 5° relative to the plane of the center panel 14.

Accordingly, a can end 12A configured as shown in FIGS. 16-18 utilizes less material compared to a prior art can end of the same type, model, and/or style. By way of a specific, but non-limiting example, a prior art "standard 307" can end is used in containers for tuna, vegetables, fruit, dog food as well as other products. A "standard 307" can end in its final form has a diameter of substantially 3 7/16 inch. Such a "standard 307" is formed from a blank having an initial diameter of 3.933 inches and an original thickness of 0.0087 inch. Thus, the volume of a prior art blank for a "standard 307" can end is 0.1057 in.$^3$ An "improved 307" can end 12A configured as shown in FIGS. 16-18 is formed from a blank having an initial diameter of 4.095 inches and an original thickness of 0.0075 inch. Thus, the volume of the blank for an "improved 307" can end 12A, as described above, is 0.0988 in.$^3$ It is noted that, such an "improved 307" can end 12A is an "enhanced can end," as defined above, because the blank used to form the "improved 307" can end 12A has a diameter that is larger than the "established blank size" for a prior art "improved 307" can end. Further, as the "established thickness" for a "standard 307" can end is 0.0087 inch, the "improved 307" can end 12A also has a "decreased original thickness." Further, because the "improved 307" can end 12A is made from a blank 10A having a "decreased original thickness" and an "enhanced diameter," the "improved 307" can end 12A is a "reduced volume" can end 12A, as defined above. This also means that the can end body 40A is a "reduced volume" can end body 40A. It is understood that this is a non-limiting example and that those of skill in the art are able to produce other specific types, models, and/or styles of can ends having any of a "decreased original thickness," "enhanced diameter" or "reduced volume" relative to those types, models, and/or styles of can ends in the configuration described above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A can end structured to be coupled to a can body, said can end comprising:
- a can end body; and
- wherein said can end body includes a down-gauging construct;
- said can end body includes a center panel, an annular portion, a chuck wall and a curl;
- said annular portion disposed about said center panel;
- said chuck wall disposed about said annular portion;
- said curl extending radially outwardly from the chuck wall; and
- wherein said annular portion includes an enhanced annular tapered portion and a subsurface step disposed within or immediately adjacent to said enhanced annular tapered portion.

2. The can end of claim 1 wherein said can end body has a decreased original thickness.

3. The can end of claim 1 wherein said can end body is an enhanced can end body.

4. The can end of claim 1 wherein said can end body is a reduced volume can end body.

5. The can end of claim 1 wherein said subsurface step is one of an enhanced annular tapered portion subsurface step, a standard chuck, subsurface step, a supra subsurface step or a standard chuck, supra subsurface step.

6. The can end of claim 1 wherein said annular portion includes a first annular planar portion, a countersink, a second annular planar portion, and a chuck wall.

7. The can end of claim 6 wherein:
- said first annular planar portion is perpendicular to said center panel; and
- said second annular planar portion is perpendicular to said center panel.

8. The can end of claim 6 wherein said enhanced annular tapered portion is a specific enhanced annular tapered portion.

9. The can end of claim 1 wherein:
- each of said center panel, said annular portion, said chuck wall, and said curl have a final thickness; and
- wherein said final thickness is between 0.0055 inch and 0.0110 inch.

10. A container comprising:
- a can body including a base and a depending sidewall, said can body defining an enclosed space;
- a can end body;
- wherein said can end body includes a down-gauging construct;
- said can end body coupled to the distal end of said can body sidewall;
- said can end body includes a center panel, an annular portion, a chuck wall and a curl;
- said annular portion disposed about said center panel;
- said chuck wall disposed about said annular portion;
- said curl extending radially outwardly from the chuck wall; and
- wherein said annular portion includes an enhanced annular tapered portion and a subsurface step disposed within or immediately adjacent to said enhanced annular tapered portion.

11. The container of claim 10 wherein said can end body has a decreased original thickness.

12. The container of claim 10 wherein said can end body is an enhanced can end body.

13. The container of claim 10 wherein said can end body is a reduced volume can end body.

14. The container of claim 10 wherein said subsurface step is one of an enhanced annular tapered portion subsurface step, a standard chuck, subsurface step, a supra subsurface step or a standard chuck, supra subsurface step.

15. The container of claim 10 wherein said annular portion includes a first annular planar portion, a countersink, a second annular planar portion, and a chuck wall.

16. The container of claim 15 wherein:
- said first annular planar portion is perpendicular to said center panel; and
- said second annular planar portion is perpendicular to said center panel.

17. The container of claim 15 wherein said enhanced annular tapered portion is a specific enhanced annular tapered portion.

18. The container of claim 10 wherein:

each of said center panel, said annular portion, said chuck wall, and said curl have a final thickness; and wherein said final thickness is between 0.0055 inch and 0.0110 inch.

* * * * *